US011330375B2

(12) United States Patent
De Haan et al.

(10) Patent No.: US 11,330,375 B2
(45) Date of Patent: May 10, 2022

(54) METHOD OF ADAPTIVE MIXING OF UNCORRELATED OR CORRELATED NOISY SIGNALS, AND A HEARING DEVICE

(71) Applicant: Oticon A/S, Smørum (DK)

(72) Inventors: Jan M. De Haan, Smørum (DK); Angela Josupeit, Smørum (DK); Michael Syskind Pedersen, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 17/025,933

(22) Filed: Sep. 18, 2020

(65) Prior Publication Data

US 2021/0092531 A1 Mar. 25, 2021

(30) Foreign Application Priority Data

Sep. 19, 2019 (EP) ..... 19198406

(51) Int. Cl.
*H04R 25/00* (2006.01)
*G10L 25/78* (2013.01)

(52) U.S. Cl.
CPC ..... *H04R 25/43* (2013.01); *G10L 25/78* (2013.01); *H04R 25/405* (2013.01); (Continued)

(58) Field of Classification Search
CPC . H04R 25/00; H04R 2225/49; H04R 2460/01
(Continued)

(56) References Cited

U.S. PATENT DOCUMENTS

2009/0016542 A1* 1/2009 Goldstein ..... H04R 3/005 381/57
2014/0376743 A1 12/2014 Hetherington
(Continued)

FOREIGN PATENT DOCUMENTS

EP 3 236 672 A1 10/2017
WO WO 2008/137870 A1 11/2008

*Primary Examiner* — Suhan Ni
(74) *Attorney, Agent, or Firm* — Birch, Stewart, Kolasch & Birch, LLP

(57) ABSTRACT

A hearing device, e.g. a hearing aid, adapted for being located at or in an ear, or to be fully or partially implanted in the head, of a user, the hearing device comprises a) an input unit providing at least two input audio data streams, each comprising a mixture of a target signal component from a target sound source and a noise component from one or more noise sources; b) a mixing processor for receiving said at least two input audio data streams, and for mixing said at least two input audio data streams, or processed versions thereof, and for providing a processed input signal based thereon; c) an output unit providing output stimuli perceivable to the user as sound based on said processed input signal or a processed version thereof. The processor is configured to process said noise component of said at least two input audio data streams, or processed versions thereof in order to reduce or avoid artefacts in said processed input signal due to said mixing. A method of operating a hearing device is further disclosed. The invention may e.g. be used in hearing aids, e.g. hearing aids configured to communicate with another device, e.g. binaural hearing aid systems.

18 Claims, 12 Drawing Sheets

(52) U.S. Cl.
CPC ..... *H04R 25/407* (2013.01); *H04R 25/453* (2013.01); *H04R 25/505* (2013.01); *H04R 2225/43* (2013.01)

(58) Field of Classification Search
USPC ..... 381/312–313, 316–317
See application file for complete search history.

(56) References Cited

U.S. PATENT DOCUMENTS

| | | | | |
|---|---|---|---|---|
| 2017/0295437 | A1* | 10/2017 | Bertelsen | G10L 21/0232 |
| 2019/0019526 | A1* | 1/2019 | Sorensen | G10L 21/0364 |
| 2020/0322735 | A1* | 10/2020 | Mosgaard | H04R 25/70 |

* cited by examiner

METHOD OF ADAPTIVE MIXING OF UNCORRELATED OR CORRELATED NOISY SIGNALS, AND A HEARING DEVICE

SUMMARY

The present application deals with hearing devices, e.g. hearing aids or headsets or speakerphones or the like, in particular with hearing devices configured to receive a multitude of (possibly) noisy audio data streams, e.g. via input transducers or by wireless or wired receivers.

When mixing two or more noisy audio data streams, it is desired that the target components and/or the noise components of the mixture fulfil certain properties. The target components should preferably be well balanced, i.e. the target from one source should preferably not be significantly louder or less loud than target components from another source. The noise components should also preferably be well balanced and preferably not be affected by the mixing, in the sense that it is perceived as annoying. The term 'balanced' or 'well balanced' is in the present context taken to mean 'equalized', e.g. in the sense that the balanced components are forced to be substantially equal, e.g. forced to be within a certain distance of each other, e.g. in that their numerical difference relative to the numerically smallest of the two components is smaller than 10%. The noise components that are 'balanced' or 'well balanced' or 'equalized' may e.g. be the noise variances of the respective audio data streams prior to mixing.

As an example, imagine fading between two microphone signals consisting of a target signal+internal (audible) microphone noise. If the two microphones are of different types, the microphone noise level may be different. When fading from one microphone signal to the other microphone signal (i.e. gradually attenuate level of a (current) signal and increase level of the other signal), it may be desirable to maintain the level of the target sound. If the microphones have different SNR, the noise level will change if the target level is kept constant during fading. Hereby the fading becomes audible. Even if the SNR at the two microphones is identical, fading is audible, as the correlated target sound (e.g. speech) and the uncorrelated noise (e.g. microphone noise, and/or wind noise) adds up in a different way, when fading.

The mixing of data streams may be the result of a shift from one program to another. A hearing device, such as a hearing aid, is typically equipped with a number of (user selectable or automatically controlled) dedicated combinations of processing parameters ('settings') that are optimized to different acoustic situations, e.g. a telephone program, a music program, a listening program, a conversation program, etc. Such individual dedicated combinations of processing parameters are typically termed 'programs'. The concepts of the present disclosure regarding the mixing of data streams are intended to apply also to the shift from one program to another (e.g. from a music listening program to a telephone program), where fading from one sound input to another may be relevant.

A Hearing Device:

In an aspect of the present application, a hearing device, e.g. a hearing aid, adapted for being located at or in an ear, or to be fully or partially implanted in the head, of a user, is provided by the present disclosure. The hearing device comprises an input unit providing at least two input audio data streams, each comprising a mixture of a target signal component from a target sound source and a noise component from one or more noise sources;

a mixing processor for receiving said at least two input audio data streams, and for mixing said at least two input audio data streams, or processed versions thereof, and for providing a processed input signal based thereon;

an output unit providing output stimuli perceivable to the user as sound based on said processed input signal or a processed version thereof.

The processor may be configured to process said noise component of said at least two input audio data streams, or processed versions thereof in order to reduce or avoid artefacts in said processed input signal due to said mixing. This may be achieved by balancing said noise components of the at least two input audio data streams in the processed input signal.

The processor may be configured to estimate a noise variance of the at least two input audio data streams prior to mixing. The noise variance may e.g. be measured as the background noise floor variance. The processor may be configured to process the noise components in dependence of the noise variances of the at least two input audio data streams.

Thereby an improved hearing device may be provided.

The mixing may be automatically initiated, e.g. based on sensor input(s) or detector input(s), e.g. based on analysis of the respective input signals. The mixing may be determined and/or initiated by the user, e.g. via a user interface (e.g. implemented as an APP of a smartphone). The mixing may comprise or consist of a fading from one signal to another over a certain time period. The fading may be defined by (e.g. time-dependent) fading parameters or by a fading curve that (e.g. gradually) decreases gain (or weight) of one input audio stream (or a processed version thereof) while increasing gain (or weight) of the other input audio stream (or a processed version thereof). Fading may be considered as a form of temporary mixing. In an embodiment, fading from one audio stream to another comprises that one audio stream is 'selected' (presented to the user) before fading is initiated, and the other audio stream is 'selected' (presented to the user) when the fading is concluded (i.e. end-weights shift from $\alpha_1=1$ and $\alpha_2=0$ to $\alpha_1=0$ and $\alpha_2=1$, respectively, or vice versa). In an embodiment, the respective weights before and after fading are not 0 and 1, but a relatively large (close to 1, e.g. $\geq 0.9$) weight is applied to the respective dominant audio stream (before and after fading) and a relatively small (non-zero, e.g. $\leq 0.1$) weight is applied to the non-dominant audio stream (before and after fading).

The processor may be configured to identify, or otherwise have access to, (some or all of) the noise components of at least some of the multitude of input audio streams, or processed versions thereof. Noise components (e.g. microphone noise) may be known or determined in advance of operation of the hearing device and made available to the hearing device, e.g. stored in a memory, or otherwise made available to the processor. Microphone noise may be extracted from a specification of the microphone or measured in advance of its use. The hearing device may e.g. be configured to (adaptively) determine noise components (e.g. environment noise) by estimating noise in the environment during speech pauses.

The term 'noise source' may include one or more of microphone noise (inherent noise in the microphone), ambient acoustic or mechanical noise, and electromagnetically induced noise. The term 'noise source' may include one or more competing (non-target) speech sources that (currently) are considered noise by the user.

The noise from the one or more noise sources of at least two of the input audio data streams may be un-correlated (e.g. microphone noise or wind noise). The noise from the one or more noise sources of at least two of the input audio data streams may be correlated (e.g. acoustic noise from non-target speech, or noise from a fan, or other machine).

The target sound sources of at least two of the multitude of audio data streams may be different (i.e. the at least two input audio data streams originate from two different target sound sources). The input unit may comprise an input transducer (e.g. a microphone) for converting a local sound from the environment of the user wearing the hearing device to an electric input signal (e.g. a first audio data stream) representing said local sound. The input unit may comprise (antenna and) receiver circuitry for receiving (e.g. wirelessly receiving) a second electric input signal (e.g. a second audio data stream) from a (possibly remote) transmitter representing sound different from the local sound from the environment of the user wearing the hearing device. The at least two audio data streams may comprise said first and second audio data streams from said input transducer and from said (antenna and) receiver circuitry, respectively.

The term 'originate from' is in the present context taken to mean 'come from' or 'is provided by', or similar terminology indicating that 'A is the source of B' (here a target sound source is the source of an audio data stream).

In the present context, the term 'the target sound sources of at least two of the multitude of audio data streams are different' is taken to mean that the at least two audio data streams originate from two different target sound sources, e.g. two different talkers, or a wirelessly received target signal from a remote communication partner, and an electric input signal representative of a target speaker in the environment of the user. In other words, the term is not intended to cover two audio streams that are just displaced in time.

The target sound source of at least two of the multitude of audio data streams may be identical (i.e. the at least two input audio data streams originate from the same target sound source). The input unit may comprise at least two (e.g. first and second) input transducers (e.g. microphones), each for converting a local sound from the environment of the user wearing the hearing device to respective electric input signals (e.g. to first and second electric input signals, such as first and second audio data streams), each representing said local sound (possibly at different sound pressure levels, comprising different amounts or types of noise, etc.). The at least two input transducers may be located in different parts of the hearing device, one being e.g. located in a BTE-part adapted for being located behind an ear (pinna) of the user, and one being e.g. located in an ITE-part adapted for being located in or at an ear canal of the user, respectively. In an embodiment, the input unit comprises an input transducer (e.g. a microphone) for converting a local sound from the environment of the user wearing the hearing device to an electric input signal (e.g. a first audio data stream) representing said local sound. The input unit may further comprise (antenna and) receiver circuitry for receiving (e.g. wirelessly receiving) a second electric input signal (e.g. a second audio data stream) from a transmitter representing sound from a local sound from the environment of the user wearing the hearing device (e.g. from a speaker in the environment of the user (wearing a microphone comprising an audio transmitter). The at least two audio data streams may comprise said first and second audio data streams from said input transducer and from said (antenna and) receiver circuitry, respectively. The antenna and receiver circuitry may comprise a coil (e.g. telecoil, or other inductor) for receiving audio signals from an inductive transmitter. The antenna and receiver circuitry may comprise an RF-antenna for receiving electromagnetic signals in the GHz range, e.g. Bluetooth or equivalent.

The processor may be configured to apply at least one signal processing algorithm to the processed input signal and for providing a processed output signal. The processor may be connected to the input unit. The processor may be connected to the output unit. The processed output signal may be fed to the output unit. The at least one signal processing algorithm may e.g. comprise a noise reduction algorithm. The processor may e.g. comprise a post filter for filtering the processed input signal to attenuate noise components in the processed input signal. The processor may e.g. comprise a compressive amplification algorithm for applying a frequency and level dependent amplification or attenuation to the processed input signal (e.g. to compensate for a hearing impairment of the user).

The hearing device may comprise a filter bank allowing processing of signals in the (time-)frequency domain. The input unit may comprise respective analysis filter banks for providing said multitude of input audio data streams in a frequency sub-band representation. The input unit may comprise respective analogue to digital converters to provide each of the electric input signals as a digital audio data stream.

The output unit may comprise a synthesis filter bank for converting a frequency sub-band signal to an audio data stream in the time domain for use in the generation of said output stimuli. The output unit may comprise a loudspeaker providing output stimuli as acoustic signals (vibrations in air, e.g. directed towards an ear drum of the user). The output unit may comprise a vibrator for providing output stimuli as mechanical vibrations in scull bone of the user. The output unit may comprise an electrode array for providing output stimuli as electric stimuli of a cochlear nerve of the user. Each electrode of the electrode array may be configured to receive stimuli aimed at a different sub-frequency range of the human auditory system (e.g. below 20 kHz, such as below 12 kHz, or below 10 kHz, or below 8 kHz). In the latter case, the synthesis filter bank may (in some designs) be omitted.

The processor may be configured to estimate a level of said target components of said multitude of input audio data streams. The level may e.g. be estimated as a sound pressure level, e.g. indicated in dB SPL. The processor may be configured to estimate a signal-to-noise ratio of the multitude of input audio data streams.

Mixing may comprise fading. The processor may be configured to fade from one input audio data stream to another input audio data stream. Sometimes, it is desirable to fade from one microphone signal to the other microphone signal, e.g. if one microphone has more feedback compared to the other microphone, or if the target signal-to-noise-ratio of one microphone signal is (significantly) better than the other. The processor may be configured to maintain the level of the target signal components when fading from one input audio data stream to another. 'Fading' between first and second signals comprising audio is in the present context taken to mean to move from a situation where the first signal is presented to the user (and the second signal is attenuated or disabled) to a situation where the second signal is presented to the user (and the first signal is attenuated or disabled). The hearing device may be configured to fade from an audio stream from a microphone to an audio stream from a beamformer, or vice versa.

The fading from a first input audio data stream to a second input audio data stream over a certain fading time period may comprise that the mixing processor is configured to provide the first data stream as the processed signal at a first point in time $t_1$ and to provide the second data stream as the processed signal at a second point in time $t_2$, where the second time $t_2$ is larger than the first time $t_1$. A fading process starts by presenting one signal ('a first audio data stream') to the user and ends by presenting another signal ('a second audio data stream') to the user. The fading time $\Delta t_{fad}=t_2-t_1$ may e.g. be smaller than a predefined time range, e.g. $\Delta t_{fad}<20$ s, or <10 s, such as <5 s.

The fading from a first input audio data stream to a second input audio data stream over a certain fading time period may comprise determining respective fading parameters or a fading curve that gradually decreases a weight of the first input audio data stream, or a processed version thereof, while increasing a weight of the second input audio data stream, or a processed version thereof, and wherein the (perceived) noise level of the processed input signal is substantially unaltered during the fading.

The hearing device may be configured to initiate fading based on a detected feedback of one of said input audio data streams. The hearing device may comprise a feedback detector. The feedback detector may be configured to provide a measure of a level of feedback currently experienced from an output transducer to an input transducer (e.g. to two or more input transducers) of the hearing device.

The hearing device may comprise a voice activity detector configured to provide a VAD-control signal indicative of whether or not or with what probability a given input audio stream comprises a human voice. The voice activity detector may be configured to identify speech. The voice activity detector may be configured to indicate whether or not or with what probability a given frequency sub-band of an input audio stream comprises a human voice, e.g. speech.

The input unit may comprise at least two input transducers, each providing an electric input signal representing sound, and a beamformer filtering unit for spatially filtering said electric input signals and for providing at least one spatially filtered signal based thereon, the spatially filtered signal constituting or forming part of at least one of said multitude of input audio data streams. The input unit may e.g. comprise two or three or more input transducers.

The beamformer filtering unit may comprise at least two beamformers, configured to provide at least two spatially filtered signals, which may constitute or form part of the multitude of input audio data streams. The direction from the user to the target sound source defined by the at least two beamformers may represent two different target directions (two different target sound sources). The number of beamformers may be smaller than the number of input transducers. The number of beamformers may be larger than or equal to the number of input transducers.

Fading between respective input audio streams from said at least two beamformers may be controlled in dependence on a detected or selected target direction. A direction to a target sound source (the target direction) of current interest to the user may be automatically determined. The target direction may also be selected by the user, e.g. via a user interface, e.g. implemented on a smartphone or other portable device, e.g. comprising a graphical user interface.

The hearing device may be configured to provide that a fading time, $\Delta t$, is increased. When fading between spatially filtered (beamformed) signals (representing sound from two different target sound sources), the duration of the fading (fading time $\Delta t$) may preferably be increased compared to when fading between two microphone signals representing sound from the same target sound source (but picked up at (slightly) different locations). Thereby a switch from one target signal to another (different) target signal, possibly with quite different signal-to-noise ratios and levels may be more soft, which might otherwise be sensed by the user as abrupt or annoying.

The hearing device may be configured to fade between said at least two input audio data streams, or processed versions thereof, while ensuring that the noise components in the processed input signal are equalized to the level of the noise signal components in the input audio data stream exhibiting the largest noise level.

The hearing device may be configured to fade between said at least two input audio data streams, or processed versions thereof, while ensuring that level of the target signal components in the processed input signal is equalized. The hearing device may e.g. be configured to maintain the level of the target signal components in the processed input signal during fading from one input audio stream to another.

The hearing device may be configured to fade between said at least two input audio data streams, or processed versions thereof, the hearing device comprising a single channel post filter for attenuating noise in the processed input signal, wherein the postfilter is configured to increase attenuation of noise components of the processed input signal.

The hearing device may be constituted by or comprise a hearing aid, a headset, an earphone, an ear protection device or a combination thereof. The hearing device may include a speaker phone (e.g. adapted to be located on a table)

The hearing device may be adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the processor is configured to enhance the input signals and provide a processed output signal.

The output unit may be configured to provide stimuli perceived by the user as an acoustic signal based on a processed electric signal. The output unit may comprise a number of electrodes of a cochlear implant (for a CI type hearing device). The output unit may comprise an output transducer. The output transducer comprises a receiver (loudspeaker) for providing the stimulus as an acoustic signal to the user (e.g. in an acoustic (air conduction based) hearing device). The output transducer may comprise a vibrator for providing the stimulus as mechanical vibration of a skull bone to the user (e.g. in a bone-attached or bone-anchored hearing device).

The hearing device may comprise an input unit for providing an electric input signal representing sound. The input unit may comprise an input transducer, e.g. a microphone, for converting an input sound to an electric input signal. The input unit may comprise a wireless receiver for receiving a wireless signal comprising or representing sound and for providing an electric input signal representing said sound. The wireless receiver may e.g. be configured to receive an electromagnetic signal in the radio frequency range (3 kHz to 300 GHz). The wireless receiver may e.g. be configured to receive an electromagnetic signal in a frequency range of light (e.g. infrared light 300 GHz to 430 THz, or visible light, e.g. 430 THz to 770 THz).

The hearing device may comprise a directional microphone system adapted to spatially filter sounds from the environment, and thereby enhance a target acoustic source among a multitude of acoustic sources in the local environment of the user wearing the hearing device. The directional system may be adapted to detect (such as adaptively detect) from which direction a particular part of the microphone signal originates. This can be achieved in various different ways as e.g. described in the prior art. In hearing devices, a microphone array beamformer is often used for spatially attenuating background noise sources. Many beamformer variants can be found in literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

The hearing device may comprise antenna and transceiver circuitry (e.g. a wireless receiver) for wirelessly receiving a direct electric input signal from another device, e.g. from an entertainment device (e.g. a TV-set), a communication device, a wireless microphone, or another hearing device. The direct electric input signal may represent or comprise an audio signal and/or a control signal and/or an information signal. The hearing device may comprise demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by antenna and transceiver circuitry of the hearing device can be of any type. The wireless link may be established between two devices, e.g. between an entertainment device (e.g. a TV) and the hearing device, or between two hearing devices, e.g. via a third, intermediate device (e.g. a processing device, such as a remote control device, a smartphone, etc.). The wireless link may be used under power constraints, e.g. in that the hearing device is or comprises a portable (typically battery driven) device. The wireless link may be a link based on near-field communication, e.g. an inductive link based on an inductive coupling between antenna coils of transmitter and receiver parts. The wireless link may be based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation), etc.

The communication between the hearing device and the other device may be in the base band (audio frequency range, e.g. in a range between 0 and 20 kHz). Preferably, communication between the hearing device and the other device is based on some sort of modulation at frequencies above 100 kHz. Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). The wireless link may be based on a standardized or proprietary technology. The wireless link may be based on Bluetooth technology (e.g. Bluetooth Low-Energy technology).

The hearing device may be or form part of a portable (i.e. configured to be wearable) device, e.g. a device comprising a local energy source, e.g. a battery, e.g. a rechargeable battery. The hearing device may e.g. be a low weight, easily wearable, device, e.g. having a total weight less than 100 g.

The hearing device may comprise a forward or signal path between an input unit (e.g. an input transducer, such as a microphone or a microphone system and/or direct electric input (e.g. a wireless receiver)) and an output unit, e.g. an output transducer. The signal processor may be located in the forward path. The signal processor may be adapted to provide a frequency dependent gain according to a user's particular needs. The hearing device may comprise an analysis path comprising functional components for analyzing the input signal (e.g. determining a level, a modulation, a type of signal, an acoustic feedback estimate, etc.). Some or all signal processing of the analysis path and/or the signal path may be conducted in the frequency domain. Some or all signal processing of the analysis path and/or the signal path may be conducted in the time domain.

An analogue electric signal representing an acoustic signal may be converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time t (or n), each audio sample representing the value of the acoustic signal at t by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. A time frame may comprise 64 or 128 audio data samples. Other frame lengths may be used depending on the practical application.

The hearing device may comprise an analogue-to-digital (AD) converter to digitize an analogue input (e.g. from an input transducer, such as a microphone) with a predefined sampling rate, e.g. 20 kHz. The hearing devices may comprise a digital-to-analogue (DA) converter to convert a digital signal to an analogue output signal, e.g. for being presented to a user via an output transducer.

The hearing device, e.g. the input unit, and or the antenna and transceiver circuitry may comprise a TF-conversion unit for providing a time-frequency representation of an input signal. The time-frequency representation may comprise an array or map of corresponding complex or real values of the signal in question in a particular time and frequency range. The TF conversion unit may comprise a filter bank for filtering a (time varying) input signal and providing a number of (time varying) output signals each comprising a distinct frequency range of the input signal. The TF conversion unit comprise a Fourier transformation unit for converting a time variant input signal to a (time variant) signal in the (time-)frequency domain. In the frequency range considered by the hearing device from a minimum frequency $f_{min}$ to a maximum frequency $f_{max}$ may comprise a part of the typical human audible frequency range from 20 Hz to 20 kHz, e.g. a part of the range from 20 Hz to 12 kHz.

Typically, a sample rate $f_s$ is larger than or equal to twice the maximum frequency $f_{max}$, $f_s \geq 2f_{max}$. A signal of the forward and/or analysis path of the hearing device may be split into a number NI of frequency bands (e.g. of uniform width), where NI is e.g. larger than 5, such as larger than 10, such as larger than 50, such as larger than 100, such as larger than 500, at least some of which are processed individually. The hearing device may be adapted to process a signal of the forward and/or analysis path in a number NP of different frequency channels (NP≤NI). The frequency channels may be uniform or non-uniform in width (e.g. increasing in width with frequency), overlapping or non-overlapping.

The hearing device may be configured to operate in different modes, e.g. a normal mode and one or more specific modes, e.g. selectable by a user, or automatically selectable. A mode of operation may be optimized to a specific acoustic situation or environment. A mode of operation may include a low-power mode, where functionality of the hearing device is reduced (e.g. to save power), e.g. to disable wireless communication, and/or to disable specific features of the hearing device.

The hearing device may comprise a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a smartphone), an external sensor, etc.

One or more of the number of detectors may operate on the full band signal (time domain). One or more of the number of detectors may operate on band split signals ((time-) frequency domain), e.g. in a limited number of frequency bands.

The number of detectors may comprise a level detector for estimating a current level of a signal of the forward path. The detector may be configured to decide whether the current level of a signal of the forward path is above or below a given (L-)threshold value. The level detector may operate on the full band signal (time domain). The level detector may operate on band split signals ((time-) frequency domain).

The hearing device may comprise a voice activity detector (VAD) for estimating whether or not (or with what probability) an input signal comprises a voice signal (at a given point in time). A voice signal is in the present context taken to include a speech signal from a human being. It may also include other forms of utterances generated by the human speech system (e.g. singing). The voice activity detector may be adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). The voice activity detector may be adapted to detect as a VOICE also the user's own voice. Alternatively, the voice detector may be adapted to exclude a user's own voice from the detection of a VOICE.

The hearing device may comprise an own voice detector for estimating whether or not (or with what probability) a given input sound (e.g. a voice, e.g. speech) originates from the voice of the user of the system. The hearing device (e.g. the own vice detector) may be adapted to be able to differentiate between a user's own voice and another person's voice and possibly from NON-voice sounds. This may e.g. be an advantage in connection with the implementation of a voice control interface in the hearing device.

The number of detectors may comprise a movement detector, e.g. an acceleration sensor. The movement detector may be configured to detect movement of the user's facial muscles and/or bones, e.g. due to speech or chewing (e.g. jaw movement) and to provide a detector signal indicative thereof.

The hearing device may comprise a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

The classification unit may be based on or comprise a neural network, e.g. a rained neural network.

The hearing device may comprise an acoustic (and/or mechanical) feedback control or echo-cancelling system. Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem appears typically when the microphone and the loudspeaker are placed closely together, as e.g. in hearing aids or other audio systems. Some other classic situations with feedback problems are telephony, public address systems, headsets, audio conference systems, etc. Adaptive feedback cancellation has the ability to track feedback path changes over time. It is based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal. The feedback cancellation system may contain a feedback detection/estimation unit. The hearing device may be configured to switch (e.g. fade) between microphone signals (as described in the present disclosure) based on the amount of estimated feedback.

The hearing device may further comprise other relevant functionality for the application in question, e.g. compression, noise reduction, etc.

The hearing device may comprise a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof. The hearing assistance system may comprise a speakerphone (comprising a number of input transducers and a number of output transducers, e.g. for use in an audio conference situation), e.g. comprising a beamformer filtering unit, e.g. providing multiple beamforming capabilities.

Use:

In an aspect, use of a hearing device as described above, in the 'detailed description of embodiments' and in the claims, is moreover provided. Use may be provided in a system comprising audio distribution, e.g. a system comprising a microphone and a loudspeaker in sufficiently close proximity of each other to cause feedback from the loudspeaker to the microphone during use by a user. Use may be provided in a system comprising one or more hearing aids (e.g. hearing instruments), headsets, ear phones, active ear protection systems, etc., e.g. in handsfree telephone systems, teleconferencing systems (e.g. including a speakerphone), public address systems, karaoke systems, classroom amplification systems, etc.

A Method:

In an aspect, a method of operating a hearing device, e.g. a hearing aid, adapted for being located at or in an ear, or to be fully or partially implanted in the head, of a user, is furthermore provided by the present application. The method comprises providing at least two input audio data streams, each comprising a mixture of a target signal component from a target sound source and a noise component from one or more noise sources;

receiving said at least two input audio data streams, and mixing said at least two input audio data streams, or processed versions thereof, and providing a processed input signal based thereon;

providing output stimuli perceivable to the user as sound based on said processed input signal or a processed version thereof.

The method further comprises processing said noise components of said at least two input audio data streams, or processed versions thereof in order to reduce or avoid artefacts due to said mixing in said processed input signal.

The method may further comprise balancing said noise components of the at least two input audio data streams in the processed input signal.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Other storage media include storage in DNA (e.g. in synthesized DNA strands). Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

The hearing system may be adapted to establish a communication link between the hearing device and the auxiliary device to provide that information (e.g. control and status signals, possibly audio signals) can be exchanged or forwarded from one to the other.

The auxiliary device may comprise a remote control, a smartphone, or other portable or wearable electronic device, such as a smartwatch or the like.

The auxiliary device may be or comprise a remote control for controlling functionality and operation of the hearing device(s). The function of a remote control may be implemented in a smartphone, the smartphone possibly running an APP allowing to control the functionality of the audio processing device via the smartphone (the hearing device(s) comprising an appropriate wireless interface to the smartphone, e.g. based on Bluetooth or some other standardized or proprietary scheme).

The auxiliary device may be or comprise an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

The auxiliary device may be or comprise a wireless microphone, e.g. a table microphone or a clip-on microphone.

The auxiliary device may be or comprises another hearing device. The hearing system may comprise two hearing devices adapted to implement a binaural hearing system, e.g. a binaural hearing aid system.

In a further aspect, a hearing system comprising first and second hearing devices as described above, in the 'detailed description of embodiments', and in the claims, is moreover provided. The first and second hearing devices may be adapted for being located at or in respective left and right ears, or to be fully or partially implanted in the head at respective left and right ears, of a user, the first and second hearing devices being configured to exchange information between them.

A Speakerphone:

In an aspect, a speakerphone is furthermore provided by the present application. The speakerphone comprises a multitude of microphones configured to pick up sound from an environment of the speakerphone and a mixing processor as described above, in the detailed description of embodiments and in the claims. The mixing processor is adapted to provide a processed input signal, which is transmitted to another device or system for further processing and/or presentation to one or more remote users. The speakerphone is further configured to play sound received from a remote source for perception in the environment of the speakerphone.

The speakerphone may comprise

- a sound input signal path comprising
  - an input unit providing at least two input audio data streams, each comprising a mixture of a target signal component from a target sound source and a noise component from one or more noise sources;
  - a mixing processor for receiving said at least two input audio data streams, and for mixing said at least two input audio data streams, or processed versions thereof, and for providing a processed input signal based thereon;
  - an output unit comprising a transmitter for transmitting said processed input signal or a processed version thereof to another device or system; and
- a loudspeaker signal path comprising
  - a receiver for receiving an audio data stream from another device or system,
  - signal processor for processing said audio data stream and providing a processed signal, and
  - a loudspeaker for providing an acoustic sound signal sound representative of said processed signal.

Thereby a speakerphone comprising an adaptive mixing scheme according to the present disclosure can be implemented.

It is intended that some or all of the structural features of the hearing device described above, in the 'detailed description of embodiments' or in the claims can be combined with embodiments of the speakerphone, when appropriately adapted. Embodiments of the speakerphone have the same advantages as the corresponding hearing devices.

The input unit of the speakerphone may comprise a multitude of microphones, such as two or more, such as three or more, each providing an input data stream representative of sound in the environment. Based on two microphones, different beamformers, which are listening towards different directions, can be created. The input unit of the speakerphone may comprise a beamformer filtering unit receiving said multitude of input data streams and configured to provide at least two spatially filtered (beamformed) signals directed towards at least two target sound sources in the environment of the speakerphone. The multitude of microphones may be divided into sub-sets of microphones. Each sub-set may comprise at least two microphones. A given sub-set may comprise at least one microphone that does not form of another sub-set of microphones. A reference microphone may be defined among the multitude of microphones. All sub-sets of microphones may comprise a reference microphone (designated among the microphones of the subset). All sub-sets of microphones may comprise the same reference microphone. The speakerphone may be configured to fade between the at least two spatially filtered signals and to transmit the (resulting) processed input signal (or a further processed version, e.g. a postfiltered version, thereof) to the (an)other device or system. The mixing unit may be configured to fade between two spatially filtered signals without altering the background noise level of the environment of the speakerphone in the processed input signal (or a further processed version thereof), which is transmitted to the (other device or system (e.g. a far end receiving listener of a communication device).

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve). The hearing device may comprise a speakerphone (comprising a number of input transducers and a number of output transducers, e.g. for use in an audio conference situation).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. smartphones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as hearing aids, e.g. hearing aids configured to communicate with another device, e.g. binaural hearing aid systems.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements" or "units"). Depending upon particular application, design constraints or other reasons, these elements (or units) may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids.

Figure 1B:
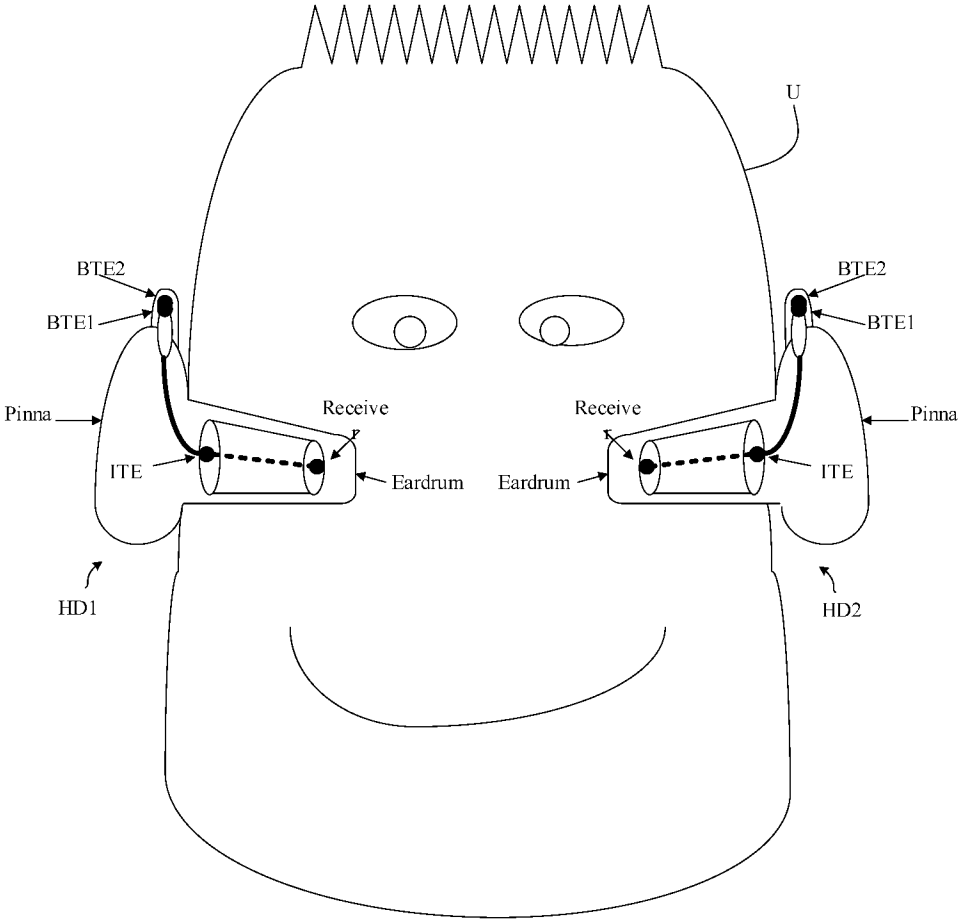
FIGS. 1A and 1B shows a scenario for receiving acoustically and/or wirelessly propagated audio data streams (or a mixture thereof) in a hearing device, FIG. 1A illustrating a side view of a user wearing a hearing device comprising respective BTE and ITE-parts at the right ear, and FIG. 1B illustrating a front view of a user wearing a hearing device at a left as well as a right ear.
Figure 1A:
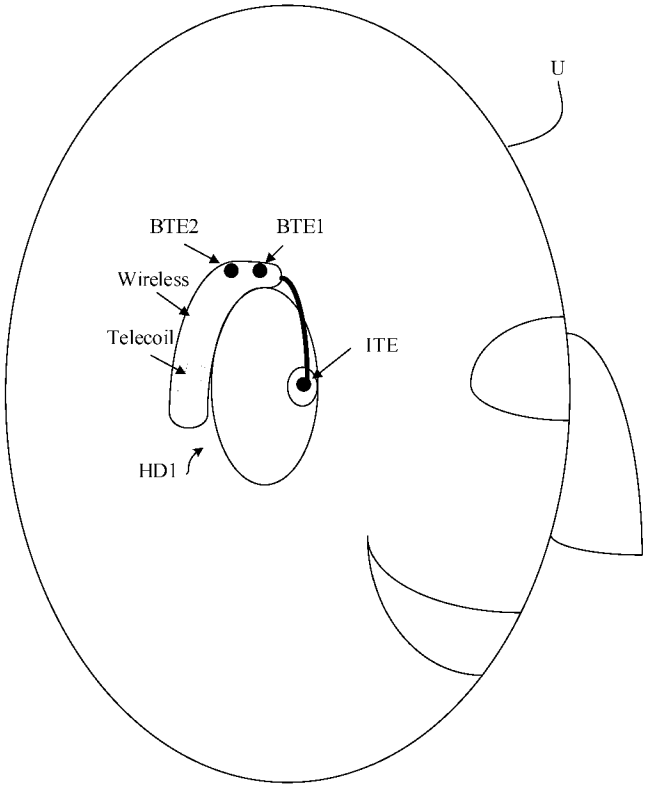

FIGS. 1A and 1B show a scenario for receiving acoustically and/or wirelessly propagated audio data streams (or a mixture thereof) in a hearing device, FIG. 1A illustrating a side view of a user wearing a hearing device comprising respective BTE and ITE-parts at the right ear, and FIG. 1B illustrating a front view of a user wearing a hearing device at a left as well as a right ear.

In the case where a hearing aid user wants to listen to a mixture of audio data streams, the hearing aid should facilitate the natural perception of sound without any inflicted artefacts due to time-varying source balancing and/or fading. In the following we consider the mixing of two noisy speech sound streams.

FIG. 1A shows a hearing device (HD) located at an ear (her a right ear) of a user (U). The hearing device comprises a BTE part adapted for being located at or behind an ear(pinna) of the user and an ITE part (ITE) adapted for being located at or in an ear canal of the user. The BTE-part comprises an input unit. The input unit comprises two microphones (BTE1, BTE2) for picking up sound from the environment of the user and two wireless audio receivers (here a telecoil (Telecoil) (or other receiver based on near-field communication) and an RF-receiver (Wireless) (e.g. based on Bluetooth or similar technology) for wirelessly receiving audio from respective audio transmitters. The hearing device of FIG. 1A may be a stand-alone hearing device or (as here) form part of a binaural hearing system, e.g. a binaural hearing aid system (as illustrated in FIG. 1B). FIG. 1B illustrates a binaural hearing system comprising first and second hearing devices (HD1, HD2) (e.g. hearing aids) adapted for being located at or in right and left ears of the user. FIG. 1B shows that the ITE-part of each hearing device (HD1, HD2) comprises a microphone (ITE) located at an environment-facing end of the ITE-part and a loudspeaker (Receiver) located at an eardrum-facing end of the ITE-part. The loudspeaker is thus configured to play into the residual volume between the ITE-part and the eardrum (Eardrum). The first and second hearing devices (HD1, HD2) are thus of the receiver in the ear type (RITE) comprising three microphones, including a microphone located at the ear canal opening (termed ITE-microphone), and two microphones at or behind pinna (termed BT-microphones), when the hearing device is operationally located on the user. Such hearing aid style may have the advantage of being able to utilize the advantage of the pinna (ITE-microphone, maintaining spatial cues) while also—when necessary in case of risk of howl at the ITE-microphone—providing sound to the user based on the BTE-microphone(s). The hearing device may e.g. comprise one or more microphones located elsewhere on the head or body of the user, e.g. in pinna, e.g. in concha, or in the ear canal, e.g. in the vicinity of the ear drum (e.g. to pick up sound from the residual volume near the ear drum).

Figure 2A:
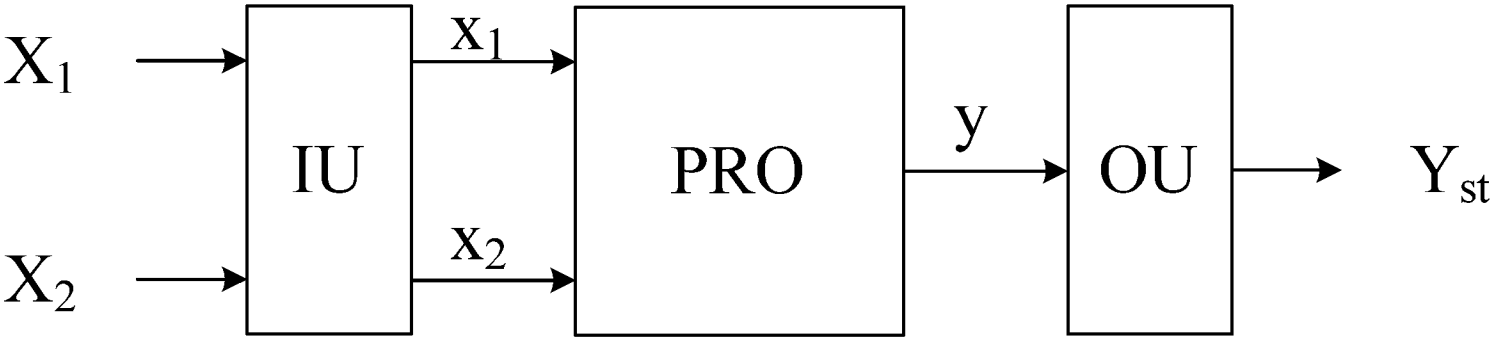
FIG. 2A shows a block diagram of a first embodiment of a hearing device according to the present disclosure.
Figure 2B:
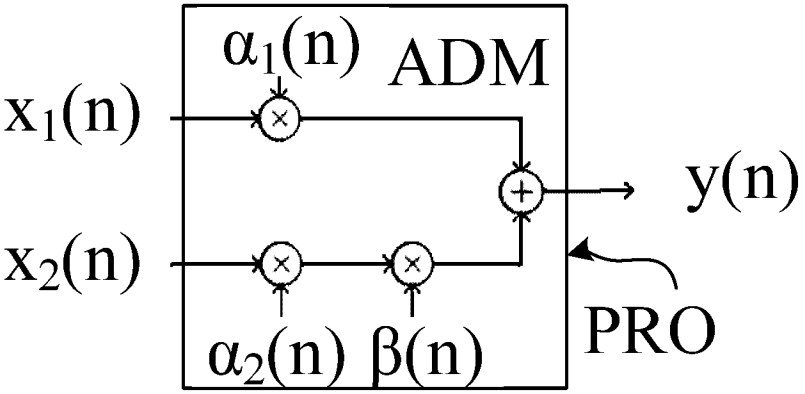
FIG. 2B illustrates a processor for mixing primary and secondary source signals $x_1(n)$ and $x_2(n)$, modified by time varying gains $\alpha_1$ and $\alpha_2$, to a processed input signal y(n)
Figure 2C:
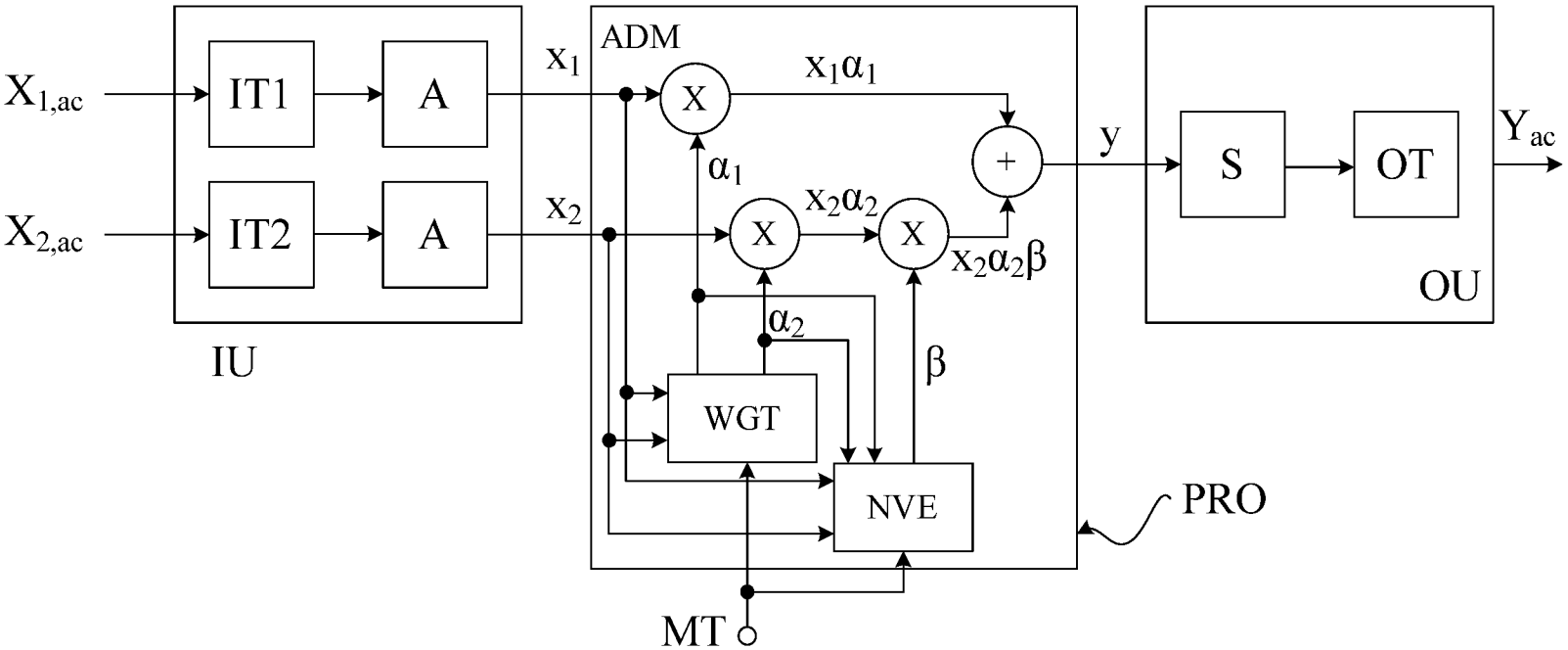
FIG. 2C shows a block diagram of a second embodiment of a hearing device according to the present disclosure.

It is assumed that audio signals are provided as sub-band signals (time-frequency domain), e.g. time domain signals which have been transformed to the time-frequency domain using an analysis filter bank and transformed back to the time domain using a synthesis filter bank before being presented to the user (see e.g. units A and S, respectively, in FIG. 2C). The Input unit may e.g. comprise at least two audio inputs. The audio inputs may e.g. comprise two microphones and/or two direct (wireless or wired) audio receivers or a mixture of microphone(s) and direct audio receiver(s). The input unit (IU, see e.g. FIG. 2A, 2C, 2D, 2E) may further comprise a number of analogue-to-digital converters (e.g. one for each analogue audio input) for converting an analogue audio input to a sampled (digital) electric input signal. The input unit may further comprise a number of analysis filter banks (A in FIG. 2C) for providing an electric input signal in a time-frequency representation as a multitude of sub-band signals, each representing a sub-range of the frequency range representing audio frequencies in the audio signal in question (e.g. up to 20 kHz or less, e.g. between 0 and 10 kHz). The output unit (OU, see e.g. FIG. 2A, 2C, 2D, 2E) may e.g. comprise a synthesis filter bank (S, in FIG. 2C) for converting frequency sub-band signals to a time domain signal for presentation to a user via an output transducer of the output unit (e.g. a loudspeaker or a vibrator of a bone conduction hearing device). The output unit may further comprise a digital-to-analogue converter (or other driving circuitry), as appropriate. The output unit may further comprise antenna and transmitter circuitry for transmitting an audio output signal to another component or device (e.g. another hearing device, if appropriate for the application in question).

In the present context, a noisy speech mixture signal $y(n)=y_s(n)+y_v(n)$ is a mixture of noisy speech signals $x_1(n)=s_1(n)+v_1(n)$, and $x_2(n)=s_2(n)+v_2(n)$, where s(n) and v(n) denote the speech and noise components, respectively, and n represents time. The speech and noise components are assumed to be uncorrelated.

The variance of the noise component $y(n)=v_1(n)+v_2(n)$ is given by $$\sigma_{y_v}^2=\sigma_{v_1}^2+\sigma_{v_2}^2+2\,\mathrm{Re}\{\mathrm{Cov}(v_1,v_2)\}.$$

Where Re {X} denotes the real part of complex number X, and $\mathrm{Cov}(v_1,v_2)$ denotes the covariance between $v_1$ and $v_2$. The expression is valid for correlated as well as uncorrelated noise. The last part ($2\,\mathrm{Re}\{\mathrm{Cov}(v_1, v_2)\}$) is zero, if the noise components ($v_1$, $v_2$) are un-correlated. In a hearing aid application, the signals are typically modified prior to mixing, e.g. for signal balancing/fading, noise reduction, etc. The mixture is given by:

$$y(n)=\alpha_1x_1(n)+\alpha_2x_2(n),$$

where $\alpha_1$ and $\alpha_2$ are gain factors. These gain factors may be time-varying.

The noise variance of the mixture, including gains, is given by $$\sigma_{y_v}^2=\alpha_1^2\sigma_{v_1}^2+\alpha_2^2\sigma_{v_2}^2+2\alpha_1\alpha_2\,\mathrm{Re}\{\mathrm{Cov}(v_1,v_2)\}.$$

Since the noise and speech components are (assumed) uncorrelated, similar relationships can be found for the speech components. In a practical application, noise and speech variance are typically frequency dependent and time-varying estimators, found using level estimators which are controlled by Voice Activity Detectors (VAD). In particular, it can be detected whether or not noise between the microphones is un-correlated (e.g. based on the elements of the inter-microphone covariance matrix).

The mixing or fading of source signals can cause annoying audible artefacts when the noise background of the signals is not equal. To overcome this problem, the noise component in the secondary source can be modified in order to avoid the artefacts.

FIG. 2A shows a block diagram of a hearing device, e.g. a hearing aid, according to a first embodiment of the present disclosure. The hearing device is e.g. adapted for being located at or in an ear, or to be fully or partially implanted in the head, of a user. The hearing device comprises an input unit (IU) providing at least two input audio data streams ($x_1$, $x_2$), e.g. in a frequency sub-band representation. Each input audio data stream comprises a mixture of a target signal component and a noise component. The hearing device further comprises a mixing processor (PRO) for receiving the at least two of input audio data streams ($x_1$, $x_2$) from the input unit (IU), or processed versions thereof, and for mixing the at least two input audio data streams, or processed versions thereof, and for providing a processed input signal y based thereon. The hearing device further comprises an output unit (OU) configured to provide output stimuli perceivable to the user as sound based on the processed input signal or a (further) processed version thereof. The mixing processor (PRO is thus coupled to the input and output units (IU, OU). Thereby a forward (audio signal processing) path of the hearing device is implemented.

Figure 2D:
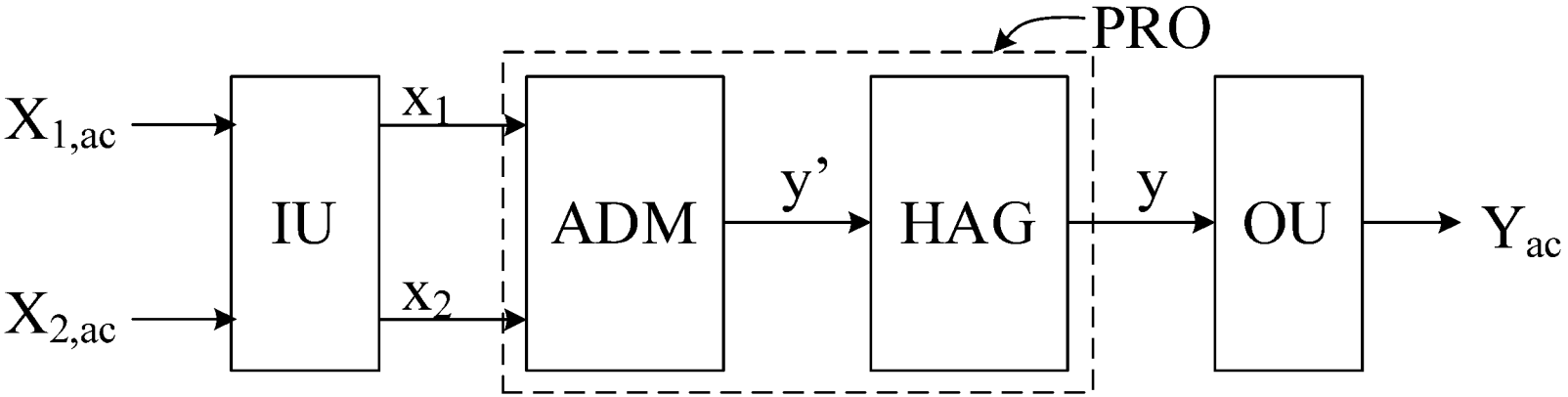
FIG. 2D shows a block diagram of a third embodiment of a hearing device according to the present disclosure.
Figure 2E:
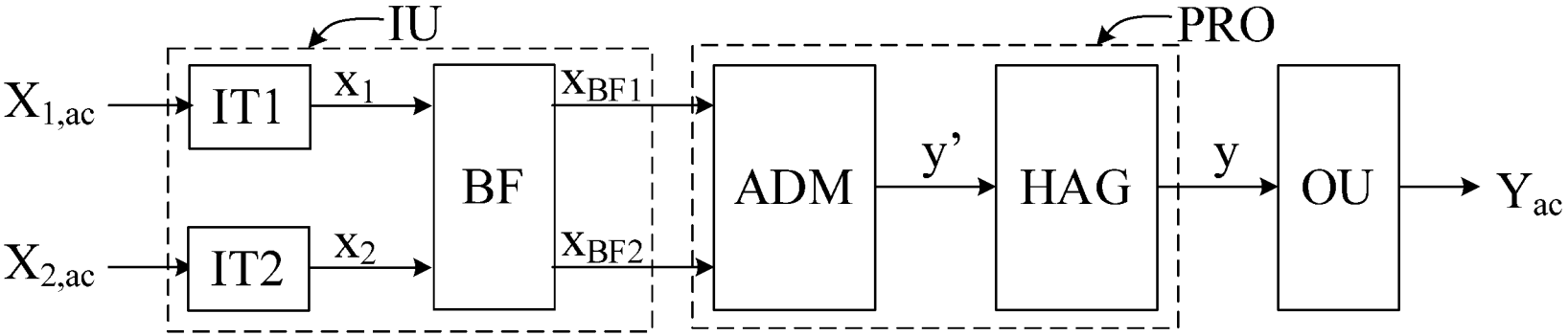
FIG. 2E shows a block diagram of a fourth embodiment of a hearing device according to the present disclosure.

FIG. 2B illustrates a processor (PRO) for mixing primary and secondary source signals (first and second input audio streams) $x_1(n)$ and $x_2(n)$, modified by time varying gains $\alpha_1$ and a, to a processed input signal y(n). The mixing may e.g. comprise fading from the primary signal (first input audio stream) to the secondary signal (second input audio stream). The functional unit handling the mixing is in the present application termed the adaptive mixing unit (ADM). In FIG. 2B the processor (PRO) consists of one function unit, the adaptive mixing unit (ADM). This need not generally be the case, though (as also indicated in FIG. 2D, 2E).

In the embodiment of FIG. 2B, prior to mixing, the secondary source may be modified by a compensation gain β. The aim of this is to provide noise source balancing (by equalize the noise level) during (and after) mixing (e.g. fading).

A compensation gain β(n) is applied to the secondary source $x_2(n)$, see FIG. 2B.

$$y(n)=\alpha_1x_1(n)+\beta\alpha_2x_2(n),$$

which means that the noise variance of the mixture, including gains, is given by $$\sigma_{y_v}^2=\alpha_1^2\sigma_{v_1}^2+\alpha_2^2\sigma_{v_2}^2+2\alpha_1\alpha_2\beta\,\mathrm{Re}\{\mathrm{Cov}(v_1,v_2)\}$$

We now normalize with the primary input noise variance $\sigma_{v_1}^2$.

$$\frac{\sigma_{y_v}^2}{\sigma_{v_1}^2}=\alpha_1^2+\alpha_2^2\beta^2\frac{\sigma_{v_2}^2}{\sigma_{v_1}^2}+2\alpha_1\alpha_2\beta\frac{\mathrm{Re}\{\mathrm{Cov}(v_1,v_2)\}}{\sigma_{v_1}^2}$$

The modification gain β can now be found by choosing a desired output variance. For example: The desired output noise variance is chosen to be equal to the primary input noise variance, i.e. $\sigma_{y_{v,target}}^2=\sigma_{v_1}^2$. Substituting this into the previous equation, we get $$\alpha_2^2\beta^2\frac{\sigma_{v_2}^2}{\sigma_{v_1}^2}+2\alpha_1\alpha_2\beta\frac{\mathrm{Re}\{\mathrm{Cov}(v_1,v_2)\}}{\sigma_{v_1}^2}-1+\alpha_1^2=0$$

This gives two solutions, of which one is negative. A negative β would imply mixing by subtraction, which we do not allow. So we only consider the solution where β is positive, i.e.

$$\beta=\frac{-B+\sqrt{B^2-4AC}}{2A},$$

Where $$A=\frac{\alpha_1^2\sigma_{v_2}^2}{\sigma_{v_1}^2},\ B=\frac{2\alpha_1\alpha_2\mathrm{Re}\{\mathrm{Cov}(v_1,v_2)\}}{\sigma_{v_1}^2},\ \text{and}\ C=\alpha_1^2-1$$

The modification gain β may be applied on time-frequency units of the secondary input which have been classified as noise-only, for example by using a Voice Activity Detector (VAD) (noise-only time-frequency units being units for which the VAD has indicated an absence of voice (e.g. speech)). The modification gain f may be found iteratively (e.g. a gradient-based minimization of the second degree polynomial). Hereby the square root can be avoided.

The same principle can be applied on the speech component for target source balancing. However, it might not be desired to modify the spectral shape of the secondary input speech component to match the primary input speech component. In this case, constraints across frequency can be applied. An exemplary constraint may be to maintain a user's loudness perception during fading. The constraint may be used to determine f for given input audio streams.

In a practical hearing aid application, it is desired to avoid operations such as square, square root, and division (due to their computational complexity (power constraints)). Most of the operations can be performed in the logarithmic domain, such that multiplication and divisions can be implemented using addition and subtraction operations respectively. Any other operations can be efficiently approximated by mapping functions or look-up tables.

FIG. 2C shows a block diagram of a hearing device according to a second embodiment of the present disclosure. The hearing device of FIG. 2C illustrates a combination of FIGS. 2A and 2B, but wherein the input unit (IU), the adaptive mixing unit (ADM), and the output unit (OU) are described in further detail. The input unit (IU) comprises first and second input transducers (IT1, IT2) each providing a (preferably digitized) input audio stream as a (full-band) time-domain signal. The input unit (IU) further comprises respective analysis filter banks (A) for converting the two input audio streams to respective first and second frequency sub-band signals, thereby providing the first and second input audio streams ($x_1$, $x_2$) in a time-frequency representation. The adaptive mixing unit (ADM) receives the first and second input audio streams ($x_1$, $x_2$) and applies time varying gains (weights) $\alpha_1$, $\alpha_2$, β to the first ($\alpha_1$) and second ($\alpha_2$, β) input audio streams ($x_1$, $x_2$) to provide modified first and second input audio streams ($x_1\alpha_1$ and $x_2\alpha_2\beta$, respectively) and adds the modified audio streams to provide a processed input signal y ($y=x_1\alpha_1+x_2\alpha_2\beta$), as illustrated in FIG. 2B and described above. The adaptive mixing unit (ADM) further comprises a weighting unit (WGT) and a noise variance estimation unit (NVE). The weighting unit (WGT) is configured to determine the first and second time dependent weights ($\alpha_1$, $\alpha_2$) for being applied to the first and second input audio streams ($x_1$, $x_2$), respectively. The weights ($\alpha_1$, $\alpha_2$) may e.g. be determined from a (time-dependent) mixing function (e.g. a fading function, cf. e.g. FIG. 3, 4, e.g. stored in a memory of the hearing device) in dependence of a trigger input signal MT (e.g. from a user interface or determined based on outputs of one or more detectors (e.g. voice activity detectors)), e.g. based on properties of the first and second input audio streams (e.g. modulation, or noise, e.g. SNR). The trigger input signal (MT) may e.g. indicate an initiation of a fading procedure from one audio input stream (e.g. provided by a microphone or beamformer or direct audio input) to another, cf. e.g. FIG. 6B. The noise variance estimation unit (NVE) is configured to determine the compensation gain (β) for being applied to the second input audio stream ($x_2$). The compensation gain (β) may be determined in dependence of properties of the first and second input audio streams (e.g. modulation, or noise, e.g. SNR) and current values of the time dependent weights ($\alpha_1$, $\alpha_2$), e.g. as described above, and optionally of the mixing trigger input signal (MT).

FIG. 2D shows a block diagram of a hearing device according to a third embodiment of the present disclosure. The hearing device of FIG. 2D may comprise the units described in connection with FIGS. 2A, 2B and 2C. Additionally, the processor (PRO) comprises a hearing aid processor (HAG) for applying further processing algorithms to the signal y' provided by the adaptive mixing unit (ADM). The hearing aid processor (HAG) may e.g. be adapted to compensate for a hearing impairment of a user, e.g. by applying a compressive amplification algorithm to a signal of the forward path, e.g. the processed input signal y' (mixed or faded signal), or to a signal derived therefrom. The customized compressive amplification algorithm may be configured to apply a frequency and level dependent gain according to a user's particular needs. Other processing algorithms may additionally or alternatively be applied to the signal y', e.g. a noise reduction signal (e.g. a post-filter). The hearing aid processor (HAG) thereby provides processed signal y, which is fed to the output unit (OU). In the embodiment of FIG. 2D, the processor (PRO) comprises the adaptive mixing unit (ADM) and the hearing aid processor (HAG). Further functional units may be included in the processor (PRO), e.g. feedback control, etc.

FIG. 2E shows a block diagram of a fourth embodiment of a hearing device according to the present disclosure. The hearing device, e.g. a hearing aid, of FIG. 2E comprises the functional units described in connection with FIG. 2D. Additionally, the input unit comprises a beamformer filtering unit (BF). The beamformer filtering unit (BF) comprises two beamformers configured to provide respective (different) beamformed signals ($x_{BF1}$, $x_{BF2}$) based on the first and second input signals ($x_1$, $x_2$) from first and second input transducers (IT1, IT2), e.g. microphones, of the input unit (IU). The first and second beamformed signals ($x_{BF1}$, $x_{BF2}$) are e.g. provided as (different) linear combinations of the first and second input signals ($x_1$, $x_2$), e.g. $x_{BF1}=C_{11}x_1+C_{12}x_2$, and $x_{BF2}=C_{21}x_1+C_{22}x_2$, where the filter weights $C_{11}$, $C_{12}$ of the first beamformer and $C_{21}$, $C_{22}$ of the second beamformer are (generally) complex (fixed or adaptively determined, typically frequency dependent) parameters. The embodiment of FIG. 2E may e.g. be relevant for fading between two beamformed signals (from two different spatial locations), e.g. controlled by voice activity detection in the two signals ('select the signal comprising voice'). Such scenario may e.g. comprise fixed beamformers, e.g. aimed at a car-situation with possible sound sources in fixed positions e.g. to the side or the back or the front of the user wearing the hearing device. Alternatively, the scenario may be aimed at a multi talker situation where directions to dominant speakers are adaptively determined and can be faded between, e.g. based on voice activity in the beamformed signal. The embodiment of FIG. 2E is shown to comprise two input transducers (IT1, IT2), but may comprise more than two, e.g. three or four or more. Adaptive mixing may e.g. be performed on two beamformed signals created from more than two electric input signals or based on different (or partially overlapping) electric input signals. In a three-input transducer example, one input transducer may e.g. be defined as a reference, whose electric input signal is used as input to both beamformers, and the two other electric input signals are used in each their respective beamformer.

As an alternative, we may add uncorrelated noise to the mixture of uncorrelated noises such that the fading from one signal to another signal becomes inaudible. By adding uncorrelated noise, the same behavior of uncorrelated noise sources can be mimicked at both microphones. The cost of having a more similar behavior at both microphones is that more noise will be added to the least noisy microphone.

The noise characteristics of the beamformed signals $x_{BF1}$ and $x_{BF2}$ referred to above may be equalized by generating respective signals $$Y_1=(1-\alpha_1)x_{ref}+\alpha_1 x_{BF1}$$

$$Y_2=(1-\alpha_2)x_{ref}+\alpha_2 x_{BF2}$$

where $x_{ref}$ is the input data stream from a common reference microphone among the multitude of microphones. By adding a scaled reference microphone signal to each of the beamformed signals (where the beamformers point toward different target directions), similar noise characteristics at the two signals Y1 and Y2 may be obtained, hereby making a fading between the two signals less audible.

When fading between the two 'improved beamformed signals' $Y_1$, $Y_2$, the processed input signal may be expressed as $$Y=\lambda Y_1+(1-\lambda)Y_2$$

where X is a fading parameter for fading between the two "improved beamformed signals" $Y_1$, $Y_2$, and where $\alpha_1$, and $\alpha_2$ are determined such that the noise level in $Y_1$ and $Y_2$ are comparable. More than two beamformed signals, e.g. $Y_1, \ldots, Y_N$, may be used. In that case $\alpha_1, \ldots \alpha_N$ are selected such that the background noise level in each beamformed signal approximately is the same. The different $\alpha$-values may be adaptively determined over time and frequency.

Figure 3:
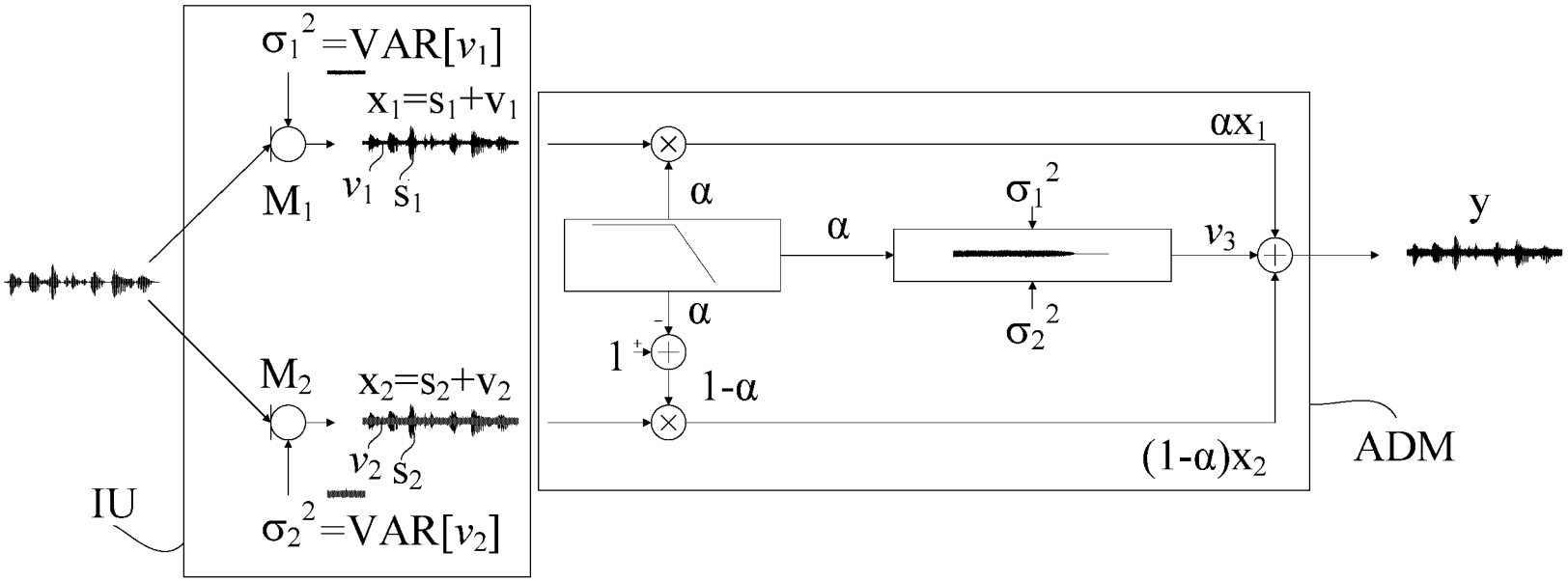
FIG. 3 illustrates an input stage of a hearing device comprising an input unit and an adaptive mixing unit according to the present disclosure providing fading between two microphone signals having different noise variances with a fading factor $\alpha$, such that, an output y(n) with an unaltered noise (and target) level (before and after fading) is provided.

The proposed solution is shown in FIG. 3 illustrating fading between two microphone signals of a hearing device with a fading factor $\alpha$, such that an output y(n) with an unaltered noise (and target) level is provided while fading from one microphone signal to the other. A possible fading function $\alpha(t)$ (when fading from microphone signal $x_1$ from microphone $M_1$ to microphone signal $x_2$ from microphone $M_2$) is shown in the middle part of FIG. 3 (in rectangular enclosure). The fading function is shown as a piecewise linear function changing (over time) from a maximum value (e.g. 1) to a minimum value (e.g. 0) over a time period $\Delta t$. Other monotonous courses of the function may be envisioned, such as a sigmoid (or sigmoid-like) function, or a linear fading in the logarithmic domain, etc. The time period $\Delta t$ over which the transition occurs may vary depending on the specific application or listening situation. The time period $\Delta t$ may e.g. be in the range between 0.5 and 5 s.

We assume a system with at least two input signals. It could e.g. be two microphones signals (as shown in FIG. 3), two telecoil (or other wirelessly received) signals, a microphone signal and a telecoil (or other wirelessly received) signal, e.g. a streamed audio signal for a TV or the like, or other signals. Each signal consists of two parts: The desired target signal ($s_1$, $s_2$), which is assumed to be correlated (preferably identical), and some additive, uncorrelated noise ($v_1$, $v_2$). With reference to FIG. 3, each input $x_1$ (i=1, 2) consists of a target component $s_1(n)$ and a noise component, $v_1(n)$, n being a time index. We assume that the target is similar at the two inputs, while the noise component is additive, and uncorrelated, with noise variances $VAR[v_1]=\sigma_{v_1}^2$ and $VAR[v_2]=\sigma_{v_1}^2$, respectively. This is graphically indicated by the two time segments schematically illustrating the two (time variant) microphone signals $x_1$ and $x_2$, respectively. The two time segments are inserted in FIG. 3 between the microphones ($M_1$, $M_2$) and the respective combination units (X). The noise variance at each microphone may be different, e.g. due to adjustments in order to make the target signal (level) at each microphone similar. The noise at each microphone may e.g. comprise (such as be dominated by) uncorrelated noise, e.g. microphone noise, and/or wind noise. Microphone noise (of each individual microphone) may be given in advance of operation of the system, e.g. measured, or estimated (e.g. based on a microphone specification), and e.g. stored in a memory.

Figure 5A:
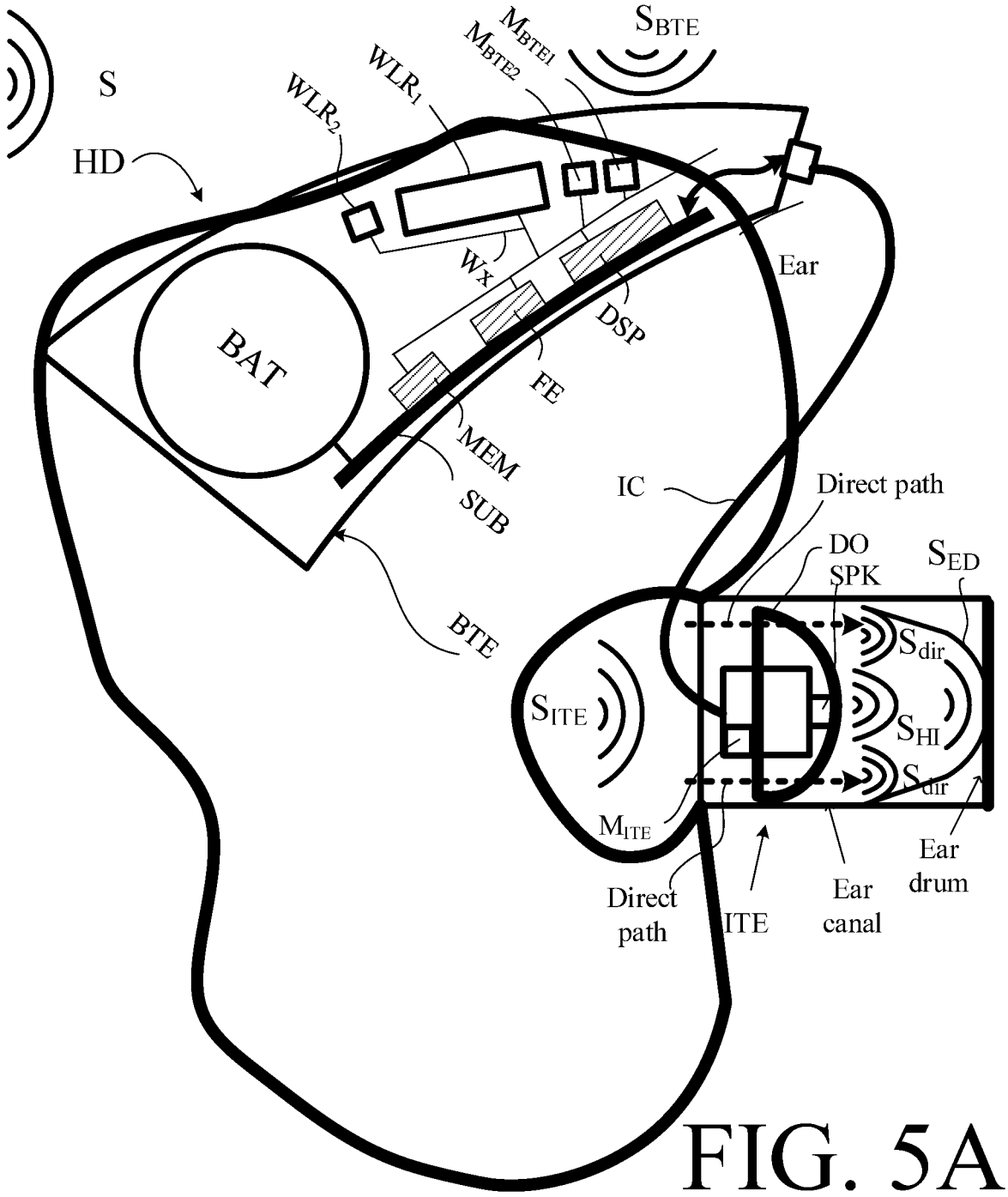
FIG. 5A shows a hearing device of the receiver in the ear type according to an embodiment of the present disclosure.
Figure 5B:
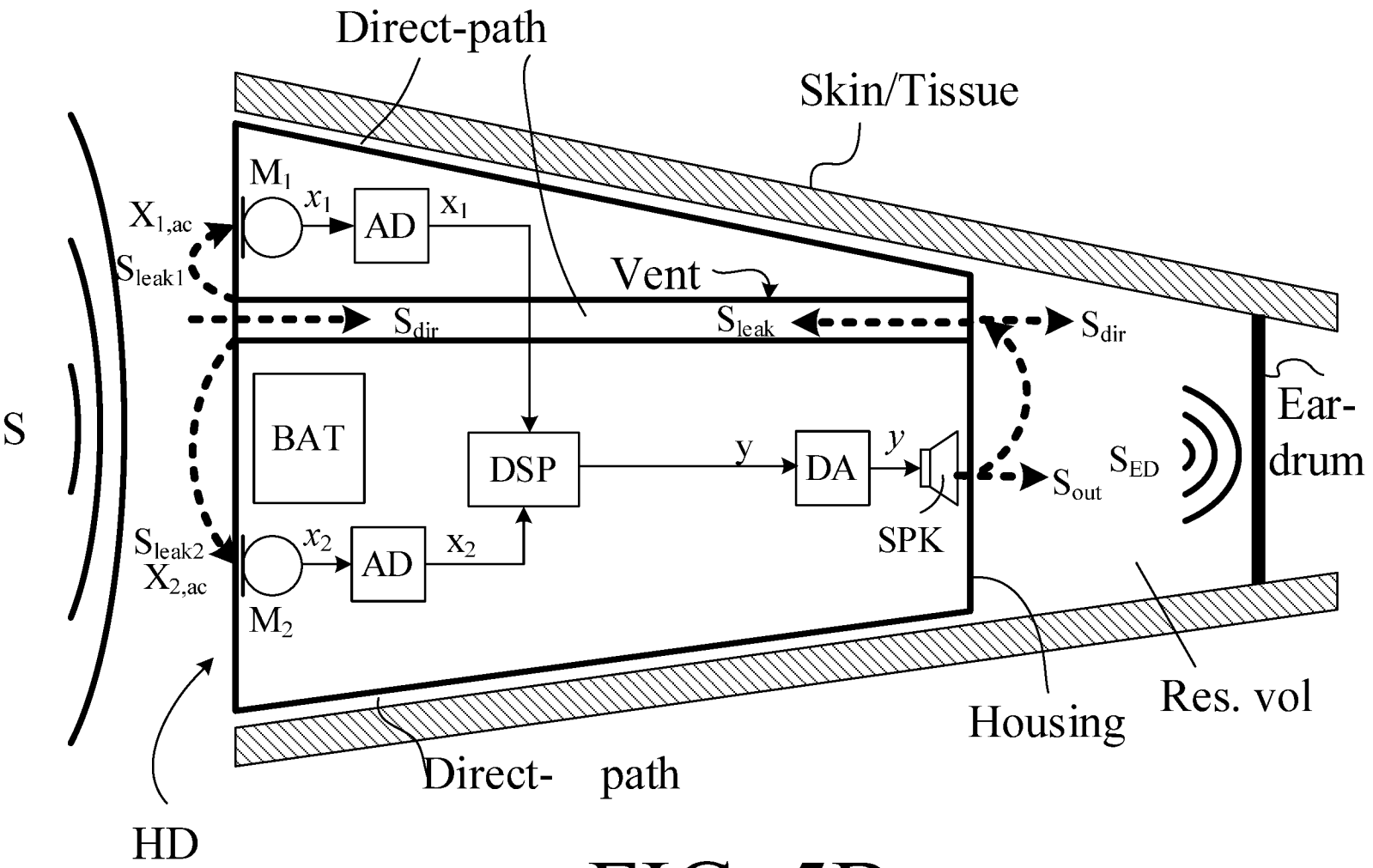
FIG. 5B shows a hearing device of the completely in the ear type according to an embodiment of the present disclosure.

Sometimes, it is desirable to fade from one microphone signal to the other microphone signal, e.g. if one microphone has more feedback compared to the other microphone (e.g. in a microphone configuration as indicated in FIG. 5A or 5B, where one microphone is more prone to feedback from the output transducer than (the) other microphone(s)). As the uncorrelated part and the correlated part of the input signals do not mix in a similar way, when fading (from the first microphone $M_1$ to the second microphone $M_2$), it is proposed to add uncorrelated noise ($v_3$) to the system in order to obtain an 'unaltered signal' (as regards noise and/or target signal or overall signal level) when fading from one microphone to the other.

In other words, in an embodiment, we aim at fading between the two microphone signals $x_1$ and $x_2$ with a fading factor $\alpha$, such that, we obtain an output y(n) with an unaltered target signal level, i.e.

$$y(n)=\alpha x_1+(1-\alpha)x_2.$$

Similarly, we aim at maintaining a constant noise level equal to the maximum noise level of the two microphone levels by adding some additional noise, $v_3$, i.e.

$$VAR[\alpha v_1]+VAR[(1-\alpha)v_2]+VAR(v_3)=\max(VAR[x_1], VAR[x_2])$$

In order to estimate the noise variance of the additional random variable, we isolate the additional noise in the above equation, i.e.

$$\sigma_{v_3}^2=\max(\sigma_{x_1}^2,\sigma_{x_2}^2)-\alpha^2\sigma_{v_1}^2-(1-\alpha)^2\sigma_{v_2}^2.$$

Assuming that $v_1$ is a Gaussian random variable with known variance $\sigma_{v_1}^2$ and $v_2$ is a Gaussian random variable with known variance $\sigma_{v_2}^2$ (e.g. microphone noise or wind noise), we can generate and add a third Gaussian random variable $v_3$ with an adaptive variance $\sigma_{v_3}^2$ depending on $\sigma_{v_1}^2$, $\sigma_{v_2}^2$, and $\alpha$.

A consequence of the proposed method is that the noise level of the output corresponds to the microphone signal with the highest noise variance.

In the setup of FIG. 3, an input stage of a hearing device comprises an input unit (IU) and an adaptive mixing unit (ADM) providing fading between two microphone signals having different noise variances. The adaptive mixing is performed with a fading factor $\alpha$, such that, an output y(n) with an unaltered noise level (before and after fading) is provided. A proceeding hearing device processor for applying one or more processing algorithms (e.g. a noise reduction algorithm (e.g. comprising post-filtering (single channel noise reduction)) and/or or a compressive amplification algorithm, etc.) may be included down-stream of the input stage (cf. e.g. hearing aid processor HAG in FIG. 2D, 2E). Further, a voice activity detector may be used to qualify the microphone signals. The target signal components may or may not be equalized (equalization of the noise components is the more important of the two).

Figure 4:
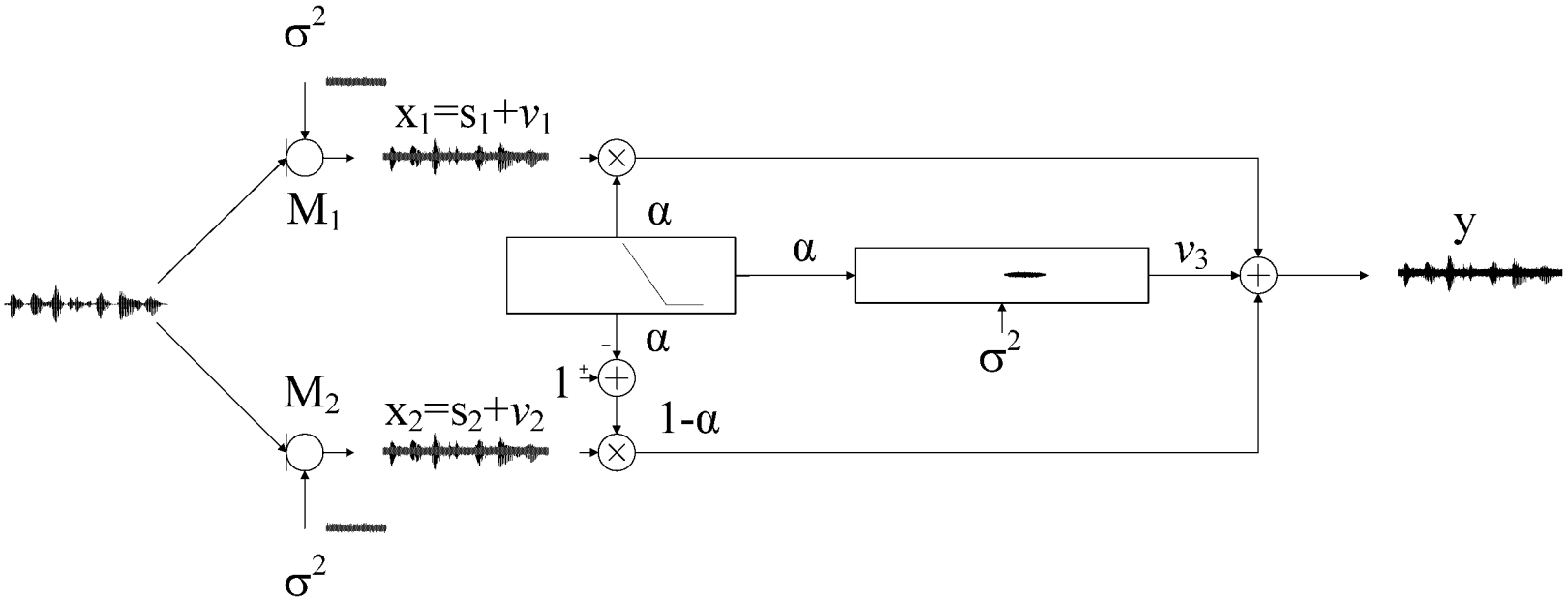
FIG. 4 shows an input stage as the one illustrated FIG. 3, but where similar noise variance at each microphone is assumed.

FIG. 4 shows an input stage as the one illustrated FIG. 3, but where similar noise variance at each microphone is assumed. However, even if the noise variance is the same, we have to add noise during fading in order to maintain a steady noise level. The input stage of FIG. 4 is similar to the input stage of FIG. 3 apart from the fact that the two microphones $M_1$, $M_2$ exhibit the same noise variance $\sigma^2$. The target signal level ($|s_1|$, $|s_2|$) may be different at the two microphones ($M_1$, $M_2$), though, e.g. if there are two target signals, e.g. one in the front or back of, and one to the side of the user wearing the hearing device (or if the two microphones are 'far apart'). Such situation reflects a scenario where an intended listening direction of the user changes over time. It may be important to maintain the microphone level during fading. Instead of fading between two microphone signals, fading between two beamformed signals (e.g. from a front- (or rear-) directed and a side-directed beamformer, respectively) may be performed. This is e.g. illustrated in FIG. 2E. In case of a changing listening direction, the amount of noise to be attenuated may likewise change. In case of fading between two beamformed signals, more than two microphone signals may be used to generate the two beamformed signals.

FIG. 5A shows a hearing device of the receiver in the ear type according to an embodiment of the present disclosure, and FIG. 5B shows a hearing device of the completely in the ear type according to an embodiment of the present disclosure.

FIG. 5A shows a BTE/RITE style hearing device according to a first embodiment of the present disclosure (BTE='Behind-The-Ear'; RITE=Receiver-In-The-Ear'). The exemplary hearing device (HD), e.g. a hearing aid, is of a particular style (sometimes termed receiver-in-the ear, or RITE, style) comprising a BTE-part (BTE) adapted for being located at or behind an ear of a user, and an ITE-part (ITE) adapted for being located in or at an ear canal of the user's ear and comprising a receiver (loudspeaker, SPK). The BTE-part and the ITE-part are connected (e.g. electrically connected) by a connecting element (IC) and internal wiring in the ITE- and BTE-parts (cf. e.g. wiring Wx in the BTE-part). The connecting element may alternatively be fully or partially constituted by a wireless link between the BTE- and ITE-parts. Other styles, e.g. comprising a custom mould adapted to a user's ear and/or ear canal, may of course be used (cf. e.g. FIG. 5B).

In the embodiment of a hearing device in FIG. 5A, the BTE part comprises an input unit comprising two input transducers (e.g. microphones) ($M_{BTE1}$, $M_{BTE2}$), each for providing an electric input audio signal representative of an input sound signal ($S_{BTE}$) (originating from a sound field S around the hearing device). The input unit further comprises two wireless receivers ($WLR_1$, $WLR_2$) (or transceivers) for providing respective directly received auxiliary audio and/or control input signals (and/or allowing transmission of audio and/or control signals to other devices, e.g. a remote control or processing device, or a telephone, or another hearing device). The hearing device (HD) comprises a substrate (SUB) whereon a number of electronic components are mounted, including a memory (MEM), e.g. storing different hearing aid programs (e.g. user specific data, e.g. related to an audiogram, or parameter settings derived therefrom, e.g. defining such (user specific) programs, or other parameters of algorithms, e.g. beamformer filter weights, and/or fading parameters) and/or hearing aid configurations, e.g. input source combinations ($M_{BTE1}$, $M_{BTE2}$ ($M_{ITE}$), $WLR_1$, $WLR_2$), e.g. optimized for a number of different listening situations. In a specific mode of operation, two or more of the electric input signals from the microphones are combined to provide a beamformed signal provided by applying appropriate (e.g. complex) weights to (at least some of) the respective signals.

The substrate (SUB) further comprises a configurable signal processor (DSP, e.g. a digital signal processor), e.g. including a processor for applying a frequency and level dependent gain, e.g. providing beamforming, noise reduction, filter bank functionality, and other digital functionality of a hearing device, e.g. implementing features according to the present disclosure (as e.g. discussed in connection with FIG. 1A, 1B, 2A, 2B, 2C, 2D, 2E). The configurable signal processor (DSP) is adapted to access the memory (MEM) e.g. for selecting appropriate parameters for a current configuration or mode of operation and/or listening situation and/or for writing data to the memory (e.g. algorithm parameters, e.g. for logging user behavior). The configurable signal processor (DSP) is further configured to process one or more of the electric input audio signals and/or one or more of the directly received auxiliary audio input signals, based on a currently selected (activated) hearing aid program/parameter setting (e.g. either automatically selected, e.g. based on one or more sensors, or selected based on inputs from a user interface). The mentioned functional units (as well as other components) may be partitioned in circuits and components according to the application in question (e.g. with a view to size, power consumption, analogue vs. digital processing, acceptable latency, etc.), e.g. integrated in one or more integrated circuits, or as a combination of one or more integrated circuits and one or more separate electronic components (e.g. inductor, capacitor, etc.). The configurable signal processor (DSP) provides a processed audio signal, which is intended to be presented to a user. The substrate further comprises a front-end IC (FE) for interfacing the configurable signal processor (DSP) to the input and output transducers, etc., and typically comprising interfaces between analogue and digital signals (e.g. interfaces to microphones and/or loudspeaker(s), and possibly to sensors/detectors). The input and output transducers may be individual separate components, or integrated (e.g. MEMS-based) with other electronic circuitry.

The hearing device (HD) further comprises an output unit (e.g. an output transducer) providing stimuli perceivable by the user as sound based on a processed audio signal from the processor or a signal derived therefrom. In the embodiment of a hearing device in FIG. 5A, the ITE part comprises (at least a part of) the output unit in the form of a loudspeaker (also termed a 'receiver') (SPK) for converting an electric signal to an acoustic (air borne) signal, which (when the hearing device is mounted at an ear of the user) is directed towards the ear drum (Ear drum), where sound signal ($S_{ED}$) is provided. The ITE-part further comprises a guiding element, e.g. a dome, (DO) for guiding and positioning the ITE-part in the ear canal (Ear canal) of the user. In the embodiment of FIG. 5A, the ITE-part further comprises a further input transducer, e.g. a microphone ($M_{ITE}$), for providing an electric input audio signal representative of an input sound signal ($S_{ITE}$) at the ear canal. Propagation of sound ($S_{ITE}$) from the environment to a residual volume at the ear drum via direct acoustic paths through the semi-open dome (DO) are indicated in FIG. 5A, 5B by dashed arrows (denoted Direct path). The directly propagated sound (indicated by sound fields $S_{dir}$) is mixed with sound from the hearing device (HD) (indicated by sound field $S_{HI}$) to a resulting sound field ($S_{ED}$) at the ear drum. The ITE-part may comprise a (possibly custom made) mould for providing a relatively tight fitting to the user's ear canal. The mould may comprise a ventilation channel to provide a (controlled) leakage of sound from the residual volume between the mould and the ear drum (to manage the occlusion effect) cf. FIG. 5B.

The electric input signals (from input transducers $M_{BTE1}$, $M_{BTE2}$, $M_{ITE}$) may be processed in the time domain or in the (time-) frequency domain (or partly in the time domain and partly in the frequency domain as considered advantageous for the application in question).

In the embodiment of FIG. 5A, the connecting element (IC) comprises electric conductors for connecting electric components of the BTE and ITE-parts. The connecting element (IC) may comprises an electric connector (CON) to attach the cable (IC) to a matching connector in the BTE-part. In another embodiment, the connecting element (IC) is an acoustic tube and the loudspeaker (SPK) is located in the BTE-part. In a still further embodiment, the hearing device comprises no BTE-part, but the whole hearing device is housed in the ear mould (ITE-part), cf. e.g. FIG. 5B.

The embodiment of a hearing device (HD) exemplified in FIGS. 5A and 5B are portable devices comprising a battery (BAT), e.g. a rechargeable battery, e.g. based on Li-Ion battery technology, e.g. for energizing electronic components of the BTE- and possibly ITE-parts. In an embodiment, the hearing device, e.g. a hearing aid, is adapted to provide a frequency dependent gain and/or a level dependent compression and/or a transposition (with or without frequency compression of one or more frequency ranges to one or more other frequency ranges), e.g. to compensate for a hearing impairment of a user. The BTE-part may e.g. comprise a connector (e.g. a DAI or USB connector) for connecting a 'shoe' with added functionality (e.g. an FM-shoe or an extra battery, etc.), or a programming device, or a charger, etc., to the hearing device (HD). Alternatively or additionally, the hearing device may comprise a wireless interface for programming and/or charging the hearing device.

FIG. 5B shows a further embodiment of a hearing aid (HD) according to the present disclosure. FIG. 5B schematically illustrates an ITE-style hearing aid according to an embodiment of the present disclosure. The hearing aid (HD) comprises or consists of an ITE-part comprising a housing (Housing), which may be a standard housing aimed at fitting a group of users, or it may be customized to a user's ear (e.g. as an ear mould, e.g. to provide an appropriate fitting to the outer ear and/or the ear canal). The housing schematically illustrated in FIG. 5B has a symmetric form, e.g. around a longitudinal axis from the environment towards the ear drum (Eardrum) of the user (when mounted), but this need not be the case. It may be customized to the form of a particular user's ear canal. The hearing aid may be configured to be located in the outer part of the ear canal, e.g. partially visible from the outside, or it may be configured to be located completely in the ear canal, possibly deep in the ear canal, e.g. fully or partially in the bony part of the ear canal.

To minimize leakage of sound (played by the hearing aid towards the ear drum of the user) from the ear canal, a good mechanical contact between the housing of the hearing aid and the Skin/tissue of the ear canal is aimed at. In an attempt to minimize such leakage, the housing of the ITE-part may be customized to the ear of a particular user.

The hearing aid (HD) comprises a number of microphones $M_q$, i=1, . . . , Q, here two (Q=2). The two microphones ($M_1$, $M_2$) are located in the housing with a predefined distance d between them, e.g. 8-10 mm, e.g. on a part of the surface of the housing that faces the environment when the hearing aid is operationally mounted in or at the ear of the user. The microphones ($M_1$, $M_2$) are e.g. located on the housing to have their microphone axis (an axis through the centre of the two microphones) point in a forward direction relative to the user, e.g. a look direction of the user (as e.g. defined by the nose of the user, e.g. substantially in a horizontal plane), when the hearing aid is mounted in or at the ear of the user. Thereby the two microphones are well suited to create a directional signal towards the front (and/or back) of the user. The microphones are configured to convert sound ($X_{1,ac}$, $X_{2,ac}$) received from a sound field S around the user at their respective locations to respective (analogue) electric signals ($x_1$, $x_2$) representing the sound. The microphones are coupled to respective analogue to digital converters (AD) to provide the respective (analogue) electric signals ($x_1$, $x_2$) as digitized signals ($x_1$, $x_2$). The digitized signals may further be coupled to respective filter banks to provide each of the electric input signals (time domain signals) as frequency sub-band signals (frequency domain signals). The (digitized) electric input signals ($x_1$, $x_2$) are fed to a digital signal processor (DSP) for processing the audio signals ($x_1$, $x_2$), e.g. including one or more of spatial filtering (beamforming), adaptive mixing (e.g. fading), (e.g. single channel) noise reduction, compression (frequency and level dependent amplification/attenuation according to a user's needs, e.g. hearing impairment), spatial cue preservation/restoration, etc. The digital signal processor (DSP) may e.g. comprise the appropriate filter banks (e.g. analysis as well as synthesis filter banks) to allow processing in the frequency domain (individual processing of frequency sub-band signals). The digital signal processor (DSP) is configured to provide a processed signal y comprising a representation of the sound field S (e.g. including an estimate of a target signal therein). The processed signal y is fed to an output transducer (here a loudspeaker (SPK), e.g. via a synthesis filter bank and, optionally, a digital to analogue converter (DA), for conversion of a processed (digital electric) signal y (or analogue version y) to a sound signal $S_{out}$.

The hearing aid (HD) may e.g. comprise a venting channel (Vent) configured to minimize the effect of occlusion (when the user speaks). In addition to allowing an (unintended) acoustic propagation path from a residual volume (cf. Res. Vol in FIG. 5B) between a hearing aid housing and the ear drum to be established, the venting channel also provides a direct acoustic propagation path of sound from the environment to the residual volume. The directly propagated sound $S_{dir}$ reaching the residual volume is mixed with the acoustic output of the hearing aid (HD) to create a resulting sound $S_{ED}$ at the ear drum. In a mode of operation, active noise suppression (ANS) is activated in an attempt to cancel out the directly propagated sound $S_{dir}$.

The ventilation channel (Vent) is asymmetrically located in the hearing aid housing (Housing). Such asymmetric location may be a result of a design constraint due to components of the hearing aid, e.g. a battery. Thereby the first and second microphones ($M_1$, $M_2$) have different feedback paths from the loudspeaker (SPK). The first microphone ($M_1$) is located closer to the ventilation channel than the second microphone ($M_2$). Other things being equal, the feedback measure (FBM1) of the first microphone is larger than the feedback measure (FBM2) of the second microphone. The scheme according to the present disclosure for controlling (e.g. to switch, such as fade, between) the use of either a beamformed signal or the signal from a single one of the input transducers in the forward path of the hearing aid may be applied to the ITE-hearing aid of FIG. 3B. Thereby more flexibility as regards the location of the input transducers and the ventilation channel relative to each other is provided without compromising (decreasing) the full-on gain value of the hearing aid. In a specific mode of operation, the signal from the (single) microphone having the lowest feedback is used for amplification and presentation to the user. Fading according to the present disclosure between the first and the second microphone signal is thus provided. Thereby the risk of feedback howl can be minimized.

The hearing aid (HD) comprises an energy source, e.g. a battery (BAT), e.g. a rechargeable battery, for energizing the components of the device.

Figure 6A:
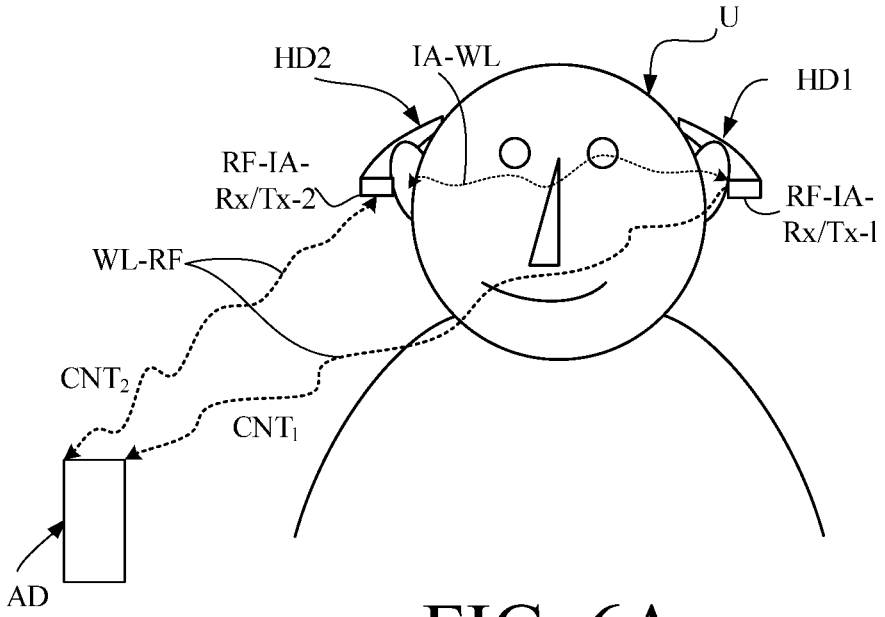
FIG. 6A shows an embodiment of a hearing system, e.g. a binaural hearing aid system, according to the present disclosure.
Figure 6B:
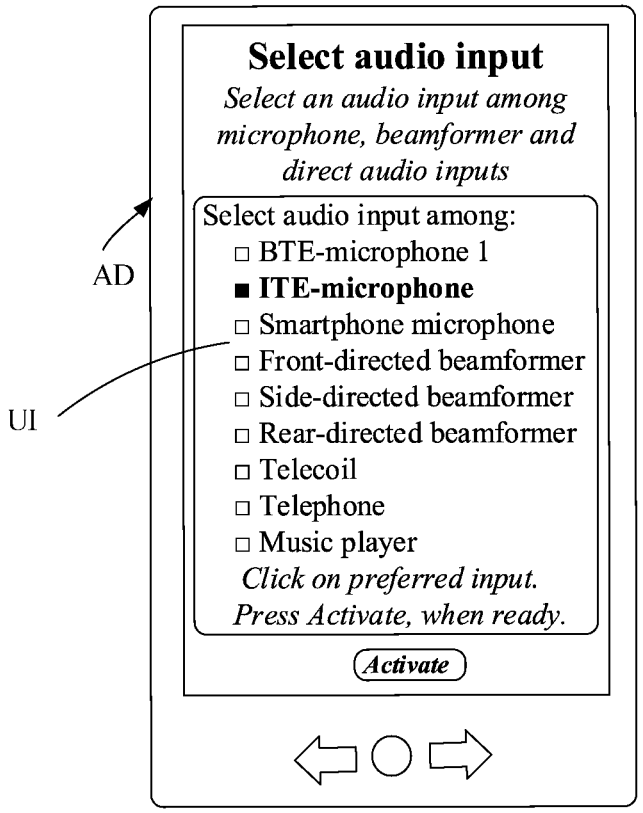
FIG. 6B illustrates an auxiliary device configured to execute an APP implementing a user interface of the hearing device or system from which a mode of operation and a currently appropriate sound input can be selected, FIG. 7 schematically illustrates a speakerphone comprising a multitude of microphones and number of beamformers configured to focus on a number of different target speakers in the environment around the speakerphone and to allow an adaptive fading between spatially filtered signals as described in the present disclosure.

FIG. 6A illustrates an embodiment of a hearing system, e.g. a binaural hearing aid system, according to the present disclosure. The hearing system comprises left and right hearing devices in communication with an auxiliary device, e.g. a remote control device, e.g. a communication device, such as a cellular telephone or similar device capable of establishing a communication link to one or both of the left and right hearing devices. FIG. 6B illustrates an auxiliary device configured to execute an application program (APP) implementing a user interface of the hearing device or system from which a mode of operation for selecting a particular sound input, e.g. an input from a particular microphone or a particular input from a wired or wireless direct reception of sound from another device (e.g. a telecoil- or RF-input), or a particular beamformed signal, can be selected.

FIG. 6A, 6B together illustrate an application scenario comprising an embodiment of a binaural hearing aid system comprising first (left) and second (right) hearing devices (HD1, HD2) and an auxiliary device (AD) according to the present disclosure. The auxiliary device (AD) comprises a cellular telephone, e.g. a Smartphone. In the embodiment of FIG. 6A, the hearing devices and the auxiliary device are configured to establish wireless links (WL-RF) between them, e.g. in the form of digital transmission links according to the Bluetooth standard (e.g. Bluetooth Low Energy, or equivalent technology). The links may alternatively be implemented in any other convenient wireless and/or wired manner, and according to any appropriate modulation type or transmission standard, possibly different for different audio sources. The auxiliary device (e.g. a Smartphone) of FIG. 6A, 6B comprises a user interface (UI) providing the function of a remote control of the hearing aid device or system, e.g. for changing program or mode of operation or operating parameters (e.g. volume) in the hearing device(s), etc. The user interface (UI) of FIG. 6B illustrates an APP (denoted 'Select audio input' ('Select an audio input among microphone, beamformer and direct audio inputs') for selecting a mode of operation of the hearing system or device where a specific one of a number of audio inputs is currently preferred by the user (and selectable via the user interface). In the example of FIG. 6B, a currently preferred audio input can be selected among the following audio inputs:

BTE-microphone 1
ITE-microphone
Smartphone microphone
Front-directed beamformer
Side-directed beamformer
Rear-directed beamformer
Telecoil
Telephone
Music player In the screen of FIG. 6B, the 'ITE-microphone' has been selected as indicated by the left solid 'tick-box' and the bold face indication 'ITE-microphone'. The screen further comprises the instruction 'Click on preferred input. Press Activate, when ready', referring to the activate button in the lower part of the screen.

When the user changes a currently preferred audio input from one e.g. Front-directed beamformer to Side-directed beamformer (e.g. in a car-situation), fading between the two inputs as proposed in the present disclosure is automatically initiated.

In embodiments of the APP, the user may be allowed to control details of a fading function between two audio input signals, e.g. the time period ($\Delta t$) of the transition and/or a possible residual weight of the audio input that was previously the preferred audio input (if relevant). In an embodiment, different configurations of fading parameters (functions, time periods, residual weight, etc.) may be defined for different pairs of audio inputs.

The hearing devices (HD1, HD2) are shown in FIG. 6A as devices mounted at the ear (behind the ear) of a user (U), cf. e.g. FIG. 5A. Other styles may be used, e.g. located completely in the ear (e.g. in the ear canal, cf. e.g. FIG. 5B), fully or partly implanted in the head, etc. As indicated in FIG. 6A, each of the hearing instruments may comprise a wireless transceiver to establish an interaural wireless link (IA-WL) between the hearing devices, e.g. based on inductive communication or RF communication (e.g. Bluetooth technology). Each of the hearing devices further comprises a transceiver for establishing a wireless link (WL-RF, e.g. based on radiated fields (RF)) to the auxiliary device (AD), at least for receiving and/or transmitting signals, e.g. control signals, e.g. information signals, e.g. including audio signals. The transceivers are indicated by RF-IA-Rx/Tx-1 and RF-IA-Rx/Tx-2 in the right (HD2) and left (HD1) hearing devices, respectively.

In an embodiment, the remote control APP is configured to interact with a single hearing device (instead of with a binaural hearing aid system).

In the embodiment of FIG. 6A, 6B, the auxiliary device is described as a smartphone. The auxiliary device may, however, be embodied in other portable electronic devices, e.g. an FM-transmitter, a dedicated remote control device, a smartwatch, a tablet computer, etc.

Figure 7:
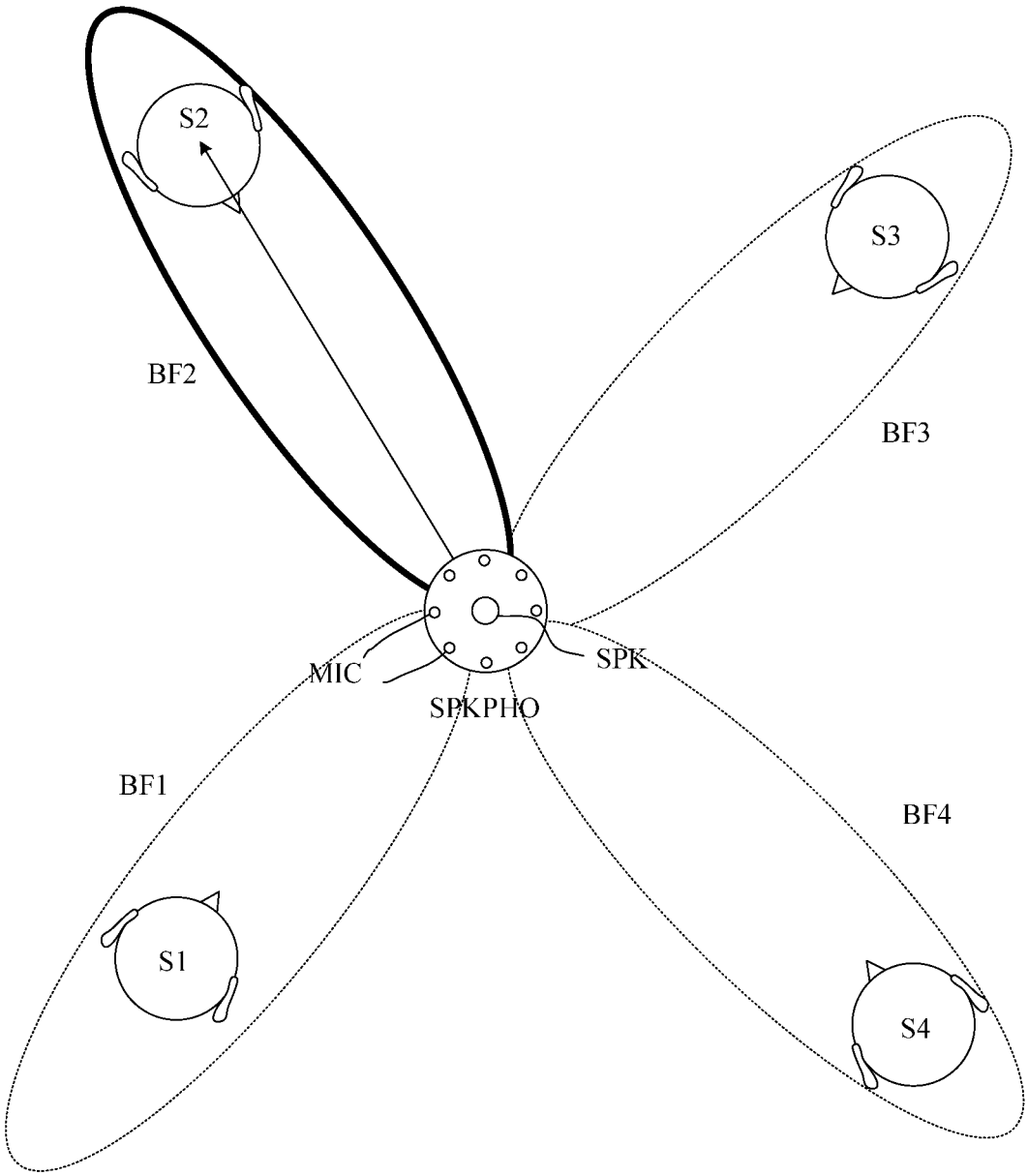

FIG. 7 schematically illustrates a speakerphone comprising an input unit comprising a multitude of microphones configured to pick up sound from an environment of the speakerphone and number of beamformers configured to focus on a number of different target speakers in the environment around the speakerphone and to allow an adaptive fading between spatially filtered signals as described in the present disclosure. The input unit of the speakerphone (SPKPHO) comprises a microphone array comprising a multitude (here 8) microphones (MIC) arranged in a predetermined pattern (here evenly distributed along the periphery of a circle). The speakerphone further comprises a loudspeaker (SPK) (here located at the centre of the speakerphone. The loudspeaker is configured to play sound received from a remote source for perception in the environment of the speakerphone. The speakerphone comprises a mixing processor as described in the present disclosure. The mixing processor is adapted to provide a processed input signal based on at least some of the signals from the multitude of microphones. The processed input signal (or a processed version thereof) is transmitted to another device or system for further processing and/or presentation to one or more remote users. The speakerphone is further configured to play sound received from a remote source for perception in the environment of the speakerphone.

The input unit of the speakerphone may comprise a beamformer filtering unit receiving the electric input signals from the multitude of microphones (MIC). The beamformer filtering unit is configured to provide at least two spatially filtered (beamformed) signals (here four is shown BF1, BF2, BF3, BF4) directed towards at least two target sound sources (here four is shown, S1, S2, S3, S4) in the environment of the speakerphone. The multitude of microphones may be divided into sub-sets of microphones. Each beamformer may be based on a subset of the microphones or all of the microphones. The speakerphone may be configured to fade between the at least two spatially filtered signals and to transmit the (resulting) processed input signal (or a further processed version, e.g. a postfiltered version, thereof) to the (an)other device or system. A currently active beamformer (BF2) is indicated by a bold outline. Speaker S2 is currently active. When (dominant) speech activity is detected in another one of the beamformers, a fading procedure according to the present disclosure is initiated. The initiation of the fading procedure may be determined by respective voice-activity-detectors (e.g. one for each spatially filtered signal).

Figure 8:
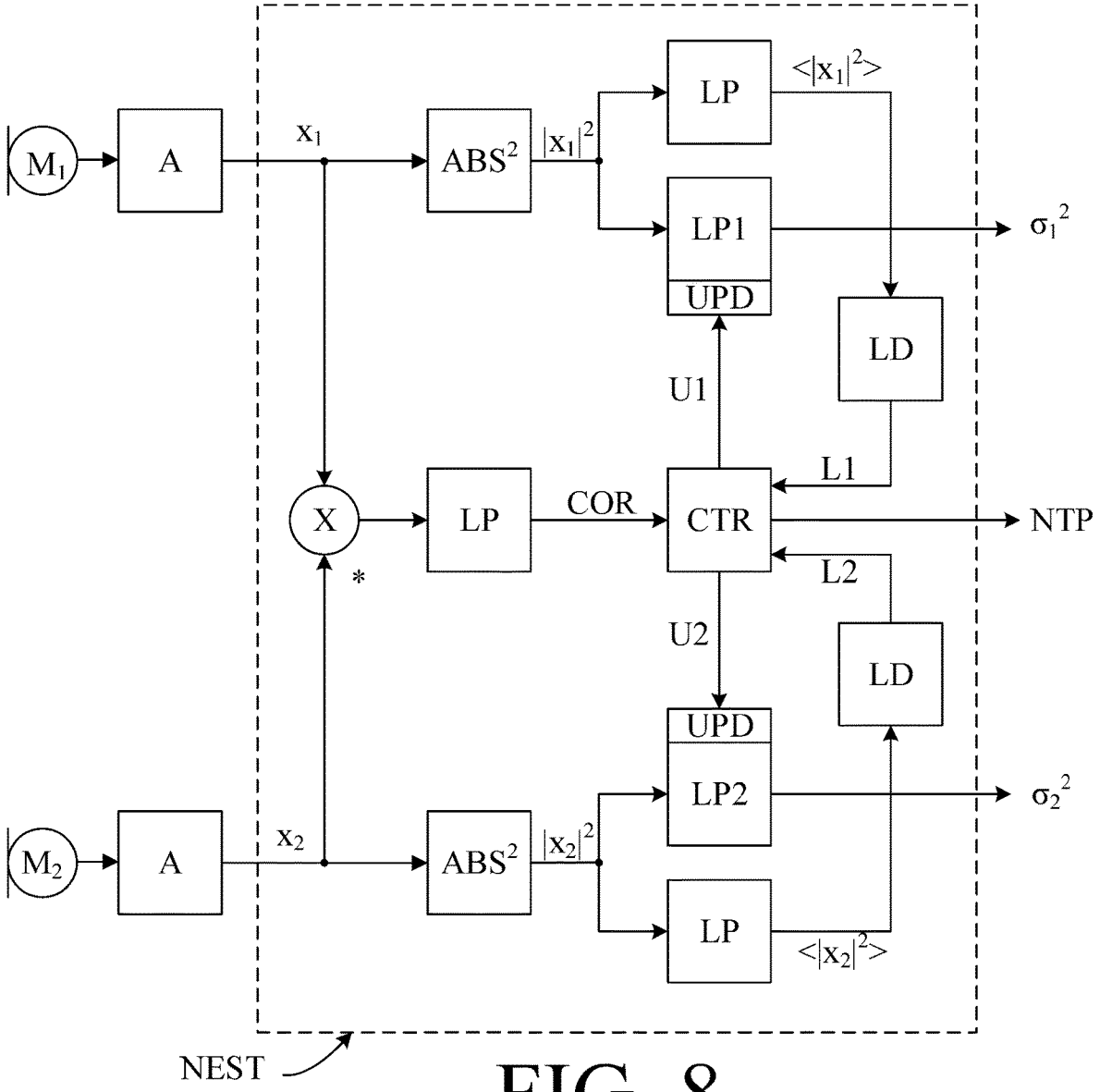
FIG. 8 shows an estimator for estimating a noise variance of the at least two input audio data streams prior to mixing of the audio streams, and FIG. 9 schematically illustrates an exemplary fading procedure between two input audio data streams having different target and noise levels.

FIG. 8 shows an estimator (NEST) for estimating a noise variance of the at least two input audio data streams prior to mixing of the audio streams. The input unit (IU) provides at least two input audio data streams (here $x_1$, $x_2$ from respective microphones $M_1$, $M_2$, the (digitized) microphone signals $x_1$, $x_2$ being converted to the frequency domain by respective analysis filter banks (A)). Each input audio data stream ($x_1$, $x_2$) comprises a mixture of a target signal component ($s_1$, $s_2$) from a target sound source and a noise component ($v_1$, $v_2$) from one or more noise sources, as exemplified in FIG. 3, 4. In FIG. 8, a procedure for estimating the respective noise variances VAR $[v_1]=\sigma_{v_1}^2$ and VAR $[v_2]=\sigma_{v_2}^2$ is exemplified.

The two input audio data streams ($x_1$, $x_2$) are multiplied in combination unit 'x' and low-pass filtered by low-pass filter (LP) to provide an estimate of the correlation (COR) between the two data streams ($x_1$, $x_2$). The cross-correlation between $x_1$ and $x_2$ is determined as $=\langle x_1\ x_2^*\rangle$, where * denotes complex conjugate (cf. * on the input to multiplication unit 'x' from $x_2$), and <-> indicates smoothing over time, e.g. using a low-pass filter (LP), assuming that the processing is performed in the filter bank domain (i.e. the (time-)frequency domain), cf. analysis filter banks (FBA) in FIG. 8. The correlation (COR) is fed to controller CTR for controlling the estimation of the respective noise variances (using control signals U1, U2) and for determining the type of noise (signal NTP) present in the current input audio data streams ($x_1$, $x_2$).

Each of the two input audio data streams ($x_1$, $x_2$) have separate (identical) noise variance estimation paths. Each noise estimation path comprises an ABS squared function for providing a magnitude squared representation ($|x_1|^2$, $|x_2|^2$) of the two input audio data streams ($x_1$, $x_2$). In each noise estimation path (m=1, 2, corresponding to M1, M2), the magnitude squared values ($|x_1|^2$, $|x_2|^2$) are low-pass filtered (LP, LPm, m=1, 2) in two different, parallel signal paths. Low-pass filter LP is configured to be continuously updated to provide an envelope ($\langle|x_1|^2\rangle$, $\langle|x_2|^2\rangle$) of the magnitude squared values. The level (L1, L2) of the envelope ($\langle|x_1|^2\rangle$, $\langle|x_2|^2\rangle$) of the magnitude squared values is estimated in respective level estimators LD, and the estimated levels (L1, L2) are fed to the controller (CTR). Low-pass filter LP1 in microphone path 1 (and correspondingly LP2 in microphone path M2) is updated in control of signal U1 (U2) from the controller (CTR). Control signal U1 (U2) is determined (at a given time) in dependence of the correlation (COR) between the two input audio data streams ($x_1$, $x_2$) and the estimated level (L1 (L2)) of the envelope ($\langle|x_1|^2\rangle$($\langle|x_2|^2\rangle$)) of the magnitude squared values of the respective input audio data streams ($x_1$ ($x_2$)). When the correlation (COR) is low, the output of the low-pass filters LP1 and LP2 represent the noise variances $\sigma_1^2$ and $\sigma_2^2$ of the first and second input audio data streams $x_1$ and $x_2$, respectively.

The controller (CTR) is configured to provide control signals U1, U2, NTP according to the following criteria:

- If L1 is low (e.g. below a first level threshold $L_{th1}$), update LP1 (U1=1).
- If L2 is low (e.g. below a second level threshold $L_{th2}$), update LP2 (U2=1).
- If COR is low (e.g. below a first correlation threshold $COR_{th1}$), while Lm (m=1, 2) is low, signal type=microphone noise (=NTP).
- If COR is low (e.g. below a first correlation threshold $COR_{th1}$), while Lm (m=1, 2) vary, signal type=wind noise (=NTP).
- If COR is high (e.g. above a second correlation threshold $COR_{th2}$), while Lm (m=1, 2) vary, signal type=speech (=NTP).

The control signal NTP can e.g. be used to discriminate between noise (including between wind noise and e.g. microphone noise) and no noise (e.g. speech) and thus implement a voice activity detector. This control signal may e.g. be used elsewhere in the hearing aid.

The estimator (NEST) of FIG. 8 may e.g. form part of the processor (PRO), cf. e.g. FIG. 2A, 2B, 2C, 2D, 2E. The estimator (NEST) may e.g. form part of the adaptive mixing unit (ADM) cf. e.g. FIG. 2C, 2D, 2E. The estimator (NEST) may e.g. form part of the noise variance estimation unit (NVE) cf. e.g. FIG. 2C.

Figure 9:
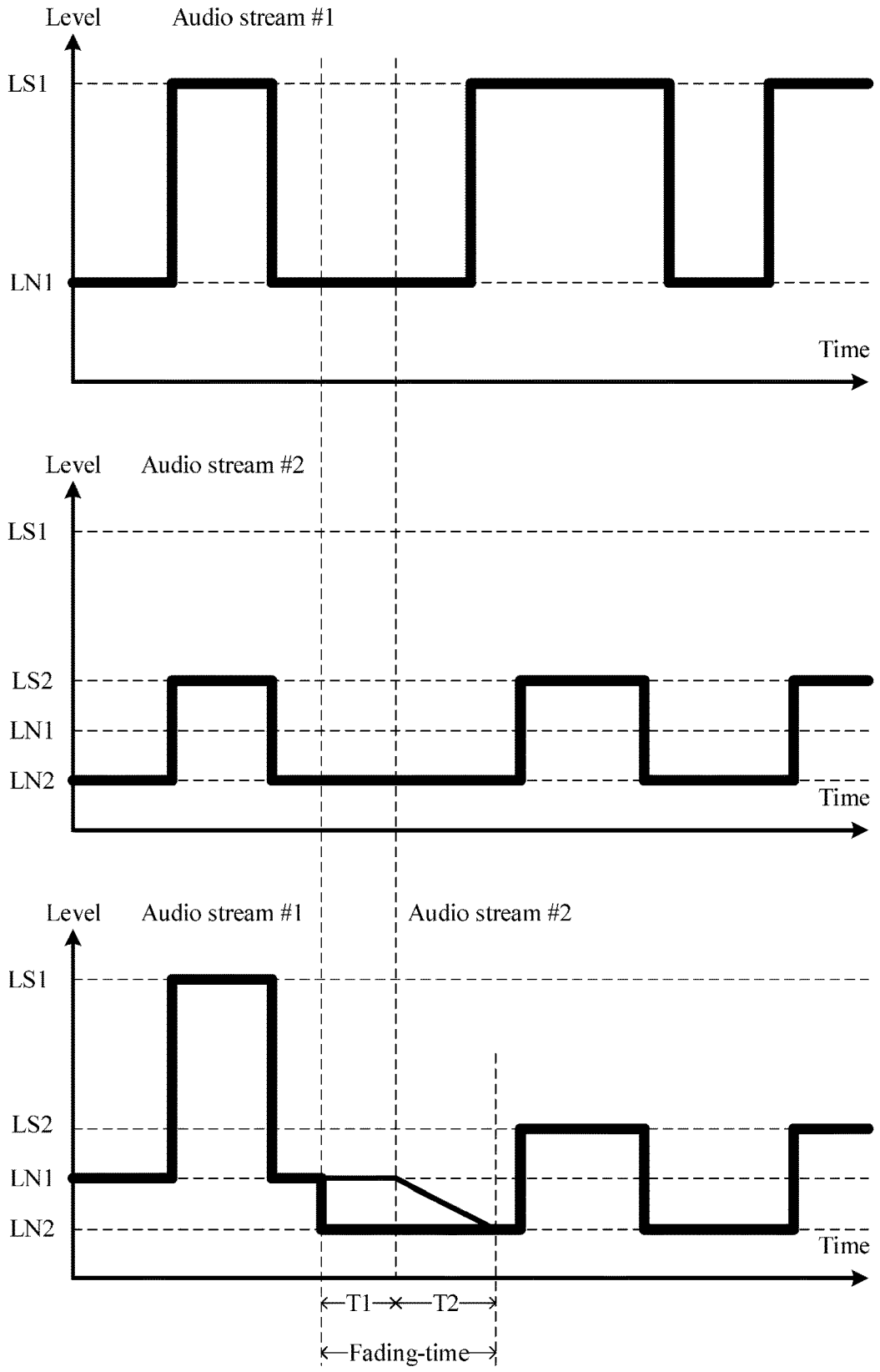

FIG. 9 schematically illustrates an exemplary fading procedure between two input audio data streams having different target and noise levels. The two upper graphs schematically illustrate first and second input audio data streams $x_1$ and $x_2$, respectively (denoted Audio stream #1 and Audio stream #2, respectively). Sequences of alternating speech and no speech are illustrated ('Level' versus 'Time'). The first and second data streams have different maximum and minimum input levels respectively (both assumed constant for simplicity). Audio stream #1 exhibits maximum level LS1 and minimum level LN1. Audio stream #2 correspondingly exhibits maximum level LS2 and minimum level LN2. The maximum level(s) (LS1, LS2) may be assumed to represent average speech levels (envelopes, top trackers). The minimum level(s) (LN1, LN2) may be assumed to represent average noise levels (envelopes, bottom trackers). All four levels (LS1, LS2, LN1, LN2) are indicated in the middle graph representing the waveform for the second input audio data stream (Audio stream #2). This is also the case in the bottom graph illustrating a fading from Audio stream #1 to Audio stream #2 over a fading time $\Delta t_{fad}$. The fading time ($\Delta t_{fad}$=T1+T2) may e.g. be larger than a minimum time and smaller than a maximum time, e.g. 1 s$\leq\Delta t_{fad}\leq$5 s. The bottom graph illustrates an example of the fading process where the noise levels (LN1, LN2) represent the noise variance estimates $\sigma_1^2$ and $\sigma_2^2$ of the respective audio streams. Instead of abruptly changing (from Audio stream #1 to Audio stream #2, the noise level of the mixed signal remain the level (LN1) of Audio stream #1 for a short period of time (T1) before it gradually (over time T2) changes to the level (L2) of Audio stream #2. Thereby significant artifacts in the mixing process is avoided.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method are not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein but are to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing device adapted for being located at or in an ear, or to be fully or partially implanted in the head, of a user, the hearing device comprising an input unit providing at least two input audio data streams, each comprising a mixture of a target signal component from a target sound source and a noise component from one or more noise sources;

a processor for receiving said at least two input audio data streams, and for mixing said at least two input audio data streams, or processed versions thereof, and for providing a processed input signal based thereon;

an output unit providing output stimuli perceivable to the user as sound based on said processed input signal or a processed version thereof;

wherein, the processor is configured to process said noise component of said at least two input audio data streams, or processed versions thereof, in order to reduce or avoid artefacts in said processed input signal due to said mixing by balancing said noise components of the at least two input audio data streams in the processed input signal, and fade from a first input audio data stream to a second input audio stream, wherein said fading from a first input audio data stream to a second input audio data stream over a certain fading time period comprises determining respective fading parameters or a fading curve that gradually decreases a weight of said first input audio data stream, or a processed version thereof, while increasing a weight of said second input audio data stream, or a processed version thereof, and wherein the perceived noise level of the processed input signal is substantially unaltered during said fading.

2. A hearing device according to claim 1 wherein the processor is configured to estimate a noise variance of the at least two input audio data streams prior to mixing.

3. A hearing device according to claim 2 wherein the processor is configured to process said noise components in dependence of said noise variances of the at least two input audio data streams.

4. A hearing device according to claim 1 wherein the at least two input audio data streams originate from two different target sound sources.

5. A hearing device according to claim 1 wherein the at least two input audio data streams originate from the same target sound source.

6. A hearing device according to claim 1 wherein the processor is configured to estimate a level of said target components of said at least two input audio data streams.

7. A hearing device according claim 6 configured to fade between said at least two input audio data streams, or processed versions thereof, while ensuring that the level of the target signal components in the processed input signal is equalized.

8. A hearing device according to claim 1 wherein said fading from a first input audio data stream to a second input audio data stream over a certain fading 5 time period comprises that the mixing processor is configured to provide the first data stream as the processed signal at a first point in time t1 and to provide the second data stream as the processed signal at a second point in time t2, where the second time t2 is larger than the first time t1.

9. A hearing device according to claim 8 configured to provide that a fading time, Δtfad, is increased.

10. A hearing device according to claim 1, wherein said processor is configured to initiate fading based on a detected feedback of one of said input audio data streams.

11. A hearing device according to claim 1 comprising a voice activity detector configured to provide a VAD-control signal indicative of whether or not or with what probability a given input audio stream comprises a human voice.

12. A hearing device according to claim 1 wherein the input unit comprises at least two input transducers, each providing an electric input signal representing sound, and a beamformer filtering unit for spatially filtering said electric input signals and for providing at least one spatially filtered signal based thereon, the spatially filtered signal constituting or forming part of at least one of said at least two input audio data streams.

13. A hearing device according to claim 12 wherein the beamformer filtering unit comprises at least two beamformers, configured to provide at least two spatially filtered signals, which may constitute or form part of the multitude of input audio data streams.

14. A hearing device according to claim 13 wherein fading between respective input audio streams from said at least two beamformers is controlled in dependence on a detected or selected target direction.

15. A hearing device according claim 1 configured to fade between said at least two input audio data streams, or processed versions thereof, while ensuring that the noise components in the processed input signal are equalized to the level of the noise signal components in the input audio data stream exhibiting the largest noise level.

16. A hearing device according claim 1 configured to fade between said at least two input audio data streams, or processed versions thereof, the hearing device comprising a single channel post filter for attenuating noise in the processed input signal, wherein the postfilter is configured to increase attenuation of noise components of the processed input signal.

17. A hearing device according to claim 1 being constituted by or comprising a hearing aid, a headset, an earphone, an ear protection device or a combination thereof.

18. A method of operating a hearing device adapted for being located at or in an ear, or to be fully or partially implanted in the head, of a user, the method comprising providing at least two input audio data streams, each comprising a mixture of a target signal component from a target sound source and a noise component from one or more noise sources;

receiving said at least two input audio data streams, and mixing said at least two input audio data streams, or processed versions thereof, and providing a processed input signal based thereon;

providing output stimuli perceivable to the user as sound based on said processed input signal or a processed version thereof;

processing said noise components of said at least two input audio data streams, or processed versions thereof in order to reduce or avoid artefacts due to said mixing in said processed input signal, by balancing said noise components of the at least two input audio data streams in the processed input signal; and fading from one input audio data stream to another input audio data stream, wherein said fading from a first input audio data stream to a second input audio data stream over a certain fading time period comprises determining respective fading parameters or a fading curve that gradually decreases a weight of said first input audio data stream, or a processed version thereof, while increasing a weight of said second input audio data stream, or a processed version thereof, and wherein the perceived noise level of the processed input signal is substantially unaltered during said fading.

* * * * *